US012078024B2

(12) United States Patent
Morgan

(10) Patent No.: US 12,078,024 B2
(45) Date of Patent: Sep. 3, 2024

(54) TOOL AND METHOD FOR CEMENTING AN ANNULUS IN A SUBSEA OIL OR GAS WELL

(71) Applicant: SUBSEA ENGENUITY LIMITED, Inverurie (GB)

(72) Inventor: Michael Graham Morgan, Banff (GB)

(73) Assignee: SUBSEA ENGENUITY LIMITED, Inverurie (GB)

( * ) Notice: Subject to any disclaimer, the term of this patent is extended or adjusted under 35 U.S.C. 154(b) by 162 days.

(21) Appl. No.: 17/784,559

(22) PCT Filed: Dec. 10, 2020

(86) PCT No.: PCT/EP2020/085571
§ 371 (c)(1),
(2) Date: Jun. 10, 2022

(87) PCT Pub. No.: WO2021/116304
PCT Pub. Date: Jun. 17, 2021

(65) Prior Publication Data

US 2023/0003095 A1 Jan. 5, 2023

(30) Foreign Application Priority Data

Dec. 12, 2019 (GB) ..... 1918328

(51) Int. Cl.
*E21B 33/05* (2006.01)
*E21B 33/038* (2006.01)
(Continued)

(52) U.S. Cl.
CPC ..... *E21B 33/05* (2013.01); *E21B 33/038* (2013.01); *E21B 33/143* (2013.01); *E21B 43/11* (2013.01)

(58) Field of Classification Search
CPC .... E21B 33/05; E21B 33/038; E21B 33/0353; E21B 33/143; E21B 43/11
See application file for complete search history.

(56) References Cited

U.S. PATENT DOCUMENTS 3,280,914 A * 10/1966 Sizer ..... E21B 34/10 166/322
6,360,822 B1 * 3/2002 Robertson ..... E21B 33/0355 166/368
(Continued)

FOREIGN PATENT DOCUMENTS

GB 2568529 A 5/2019
WO 2015026239 A2 2/2015
(Continued)

OTHER PUBLICATIONS

Bart Joppe, Riserless Subsea Well Abandonment Methodology, May 26, 2016, 19 pages, Baker Hughes.
(Continued)

*Primary Examiner* — Shane Bomar
(74) *Attorney, Agent, or Firm* — PERKINS IP LAW GROUP LLC; Jefferson Perkins

(57) ABSTRACT

A tool (1) for cementing an annulus in a subsea oil or gas well, and methods for using the tool are provided. The tool includes a safety module (2) providing fluid communication between an umbilical and a perforation and circulation module (4) mounted below it. The safety module (2) includes a mechanical lock for connection to a well head. The perforation and circulation module includes upper and lower seals (6, 8) for sealing to the inner surface of a casing; an upper perforating device (14) mounted between the seals; a lower perforating device (16) mounted below the lower seal (8); and supply (S) and return (R) fluid flow paths for circulating fluid from the safety module (2). A diversion means (20) is provided in the supply fluid flow path, operable to redirect fluid supplied to the supply fluid flow path to a space defined between the upper and lower seals (6, 8).

50 Claims, 16 Drawing Sheets

(51) Int. Cl.
*E21B 33/14* (2006.01)
*E21B 43/11* (2006.01)

(56) References Cited

U.S. PATENT DOCUMENTS

| | | | | |
|---|---|---|---|---|
| 9,488,024 | B2 * | 11/2016 | Hoffman | E21B 33/13 |
| 10,954,744 | B2 * | 3/2021 | Skeels | E21B 43/1185 |
| 2006/0005964 | A1 * | 1/2006 | Jannise | E21B 43/11<br>166/244.1 |
| 2013/0014947 | A1 * | 1/2013 | Wilkins | E21B 43/26<br>166/281 |
| 2013/0269948 | A1 * | 10/2013 | Hoffman | E21B 33/035<br>166/351 |
| 2014/0311741 | A1 * | 10/2014 | Tunget | E21B 33/13<br>166/285 |
| 2018/0112484 | A1 | 4/2018 | Bussear et al. | |
| 2018/0291713 | A1 * | 10/2018 | Jeanson | E21B 43/11 |

FOREIGN PATENT DOCUMENTS

| | | | |
|---|---|---|---|
| WO | 2015105427 | A2 | 7/2015 |
| WO | 2018017104 | A1 | 1/2018 |

OTHER PUBLICATIONS

Solutions for Subsea Well Abandonment, Presentation to the Norwegian P&A Forum Workshop, Jun. 2011, 22 pages.
European Patent Office, The International Search Report and the Written Opinion of the International Searching Authority, Mar. 2, 2021, 18 pages.

* cited by examiner

TOOL AND METHOD FOR CEMENTING AN ANNULUS IN A SUBSEA OIL OR GAS WELL

FIELD

The present invention relates to tools and methods for cementing down hole well bores and annuli between casings in wellbores. The tools and methods can find particular use when a subsea well is to be permanently abandoned by removing the wellhead apparatus.

BACKGROUND

A subsea well for oil or gas production comprises a number of concentric casings which are installed and cemented into the seabed from a drilling rig. Typically, a subsea well would comprise an outer conductor string of 30" diameter, an inner surface casing string of 20" diameter, an intermediate casing string of 13⅜" diameter and a production casing string of 9⅝". The well would be drilled in that order, in which holes for each casing string are drilled to progressively greater depths at diameters large enough to allow cement slurry to be pumped into the space between the casing string and the formation. Sometimes but not always, the cement can extend upward into the previous casing string for a distance of about 15 m (50 ft). Once set, the cement secures the casing into the formation and forms impenetrable barriers to prevent migration of well fluids into the environment.

When the well is no longer commercially viable many governments expect redundant wellhead systems to be removed from the seabed. A tested, permanent barrier must be established prior to the wellhead being severed and removed. A permanent barrier is normally defined as being a continuous plug within the well and the plug should seal within the production bore (production tubing) and extend radially outwards at the same elevation through all annuli between tubing and casings. A cement plug of about at least 100 m (328 ft) in length is typically required For safety and environmental reasons it is desirable and increasingly mandated by legislation that a so called 'category 1' well status is achieved before wellhead removal. A category 1 well has a tested barrier within the production bore and tested barriers across all annuli.

Current practice to obtain category 1 wells is to use cement slurry which is pumped into the production bore and into each annulus, as required, to establish a plug with a minimum required length not less than 100 metres. When set, the cement is accepted as providing a suitable permanent barrier.

As a typical initial step in sealing an out of use well, the production bore is filled with a cement plug at depth below the wellhead. This cement plug is placed in the production zone, typically extending for a depth of at least 100 m above the highest point at which well fluid would enter the production conduit. Such an arrangement secures leakage from the production bore in the event of failure of containment at the well head, for example if the well head is damaged or dislodged from its position on the seabed.

However, this may not always be adequate. In the event that the casing annuli are not adequately sealed the well would be classed as a 'category 2' well. Category 2 wells are not considered to be safely sealed for abandonment. They do not have the required permanent barrier to allow safe removal of the well head. Leakage paths can exist via annuli between casings/tubing.

A subsea wellhead may not be removed unless the well can be classed as a category 1 well, in which case equipment and methods for conversion of a category 2 well into category 1 well are required.

Cementing a well bore across its width, including each annulus presents a number of challenges. For subsea operations it is highly desirable to minimize the number of operations that require fitting and removal of equipment to the wellhead or into the well bore. Equipment and methods that can carry out a number of operations in a 'single trip' to the well head are desired.

SUMMARY

According to a first aspect of the invention there is provided a tool for cementing an annulus in a subsea oil or gas well, the tool comprising:

- a safety module and a perforation and circulation module;
- wherein the safety module provides fluid communication between an umbilical and the perforation and circulation module, and includes a mechanical lock for connection into engagement to a well head in use; and
- wherein the perforation and circulation module is mounted below the safety module, and comprises:
  - i) upper and lower seals for sealing to the inner surface of a casing inside a wellbore;
  - ii) at least one upper perforating device, mounted between the upper and lower seals, for perforating casing;
  - iii) at least one lower perforating device, mounted below the lower seal, for perforating wellbore casing;
  - iv) a supply fluid flow path to supply fluid from the safety module through the upper and lower seals to below the perforation and circulation module;
  - v) a return fluid flow path from between the upper and lower seals to the safety module; and
  - vi) a diversion means in the supply fluid flow path, operable to redirect fluid supplied to the supply fluid flow path to a space defined between the upper and lower seals.

Advantageously, the diversion means comprises a valve in the supply fluid flow path, operable to redirect fluid supplied to the supply fluid flow path to a space in-between the upper and lower seals. In use of the tool the space defined between the upper and lower seals is a space between the seals and the casing to which the seals engage.

Such a 'cross-over' valve may be mounted between the upper and lower seals and operable to redirect fluid. The valve may be a sliding sleeve valve provided in piping of the supply fluid flow path. The valve may be hydraulically operated. When operated the valve allows fluid communication between the supply fluid flow path and to between the upper and lower seals. When operated, the valve may redirect all of the fluid in the supply fluid flow path to between the upper and lower seals. Alternatively, when operated the valve may redirect only a portion of the fluid in the supply fluid flow path to between the upper and lower seals. Fluid redirected to between the upper and lower seals may continue along the return fluid flow path to the safety module and (via an umbilical) to a surface vessel. It will also be appreciated that the operation of the valve can allow fluid flow in the opposite direction when desired, from between the upper and lower seals to the supply fluid flow path.

As an alternative to a valve mounted between the upper and lower seals, the diversion means may comprise a valve mounted at the lower seal. The valve at the lower seal is operable redirect fluid flow of the supply fluid flow path from below the lower seal to pass to the space in-between the upper and lower seals, by bypassing the lower seal.

Alternatively, or additionally the diversion means may be provided by having a lower seal that takes the form of an inflatable or expandable packer, where controlled hydraulic or mechanical action is used to expand sealing members into sealing engagement with casing walls. The diversion means can comprise the lower seal. The lower seal can then act as a diverter when required by deflating or retracting the packer, to allow fluid supplied via the supply fluid flow path to pass back up past the lower seal and to the space in-between the upper and lower seals.

The safety module provides a mechanical lock connection to the wellhead, and so may avoid difficulties following axial movement of the tool in the wellbore, which may happen with tools relying on friction forces to grip to the inner surface of a casing in the wellbore. The mechanical lock secures the tool to the well head by movement of parts into locking engagement with the wellhead, for example with an abutment profile inside the main bore of the wellhead or on the external surface of the wellhead mandrel. The abutment profile may comprise one or more groove, typically circumferential grooves.

The lock does not rely on friction to prevent movement, in particular axial movement, of the tool from the desired location.

Thus, a portion of the mechanical lock may engage with the well head by overlapping, in at least the radial direction with one or more features such as; a groove; a protrusion; a change in diameter of the well head exterior; or a change in diameter of a bore within the interior of the well head; thereby acting against axial movement.

Alternatively, the mechanical lock may engage with the well head without a portion overlapping in the radial direction with one or more features of the well head as discussed above. This can be achieved by an engagement which has sufficient force to indent ("bite into") the exterior surface and/or an interior bore of the wellhead. Such arrangements may rely more on frictional forces, but still provide a mechanical locking effect in at least the axial direction.

The mechanical lock may be hydraulically operated.

The mechanical lock may be formed and arranged to make a clamping engagement to an abutment profile on the inside or the outside surface of the well head.

Conveniently the mechanical lock may be formed and arranged to make a clamping engagement to an inside surface of the well head e.g. to a surface in the bore leading to the wellbore itself. Such an arrangement can leave access to the outside surface of the well head available for use, even an emergency use. For example to allow fitting of a Blow Out Preventer (BOP).

The safety module will typically include passageways for several fluid flows, valving and controls for sealing or redirecting those. Appropriate sealing to the wellhead can be provided to prevent leakage of fluid into the environment.

The safety module allows fluids provided via the umbilical, to be passed into the perforation and circulation module and back into the umbilical when desired. The umbilical will typically comprise at least two conduits for flow into the supply fluid flow path and return from the return fluid flow path. Conduits for supply of hydraulic fluids, to allow hydraulic control of features of the tool; and wiring for sensor signals and/or electrical control signals may also be provided in the umbilical.

The mechanical lock may comprise a plurality of dogs, typically distributed circumferentially about a surface of the tool and operable, for example by means of an axially moving cam ring, to move outwards to engage an inner surface of a well head. In the alternative, where an outer surface of a wellhead is engaged the dogs can be arranged to move inwards for locking engagement. The axially moving cam ring may be hydraulically operated by a hydraulic system.

The dogs of a mechanical lock may engage with the well head by overlapping in at least the radial direction with one or more features of the wellhead. As an alternative an expanding split ring may be employed, to expand into locking engagement within a bore of the wellhead, or even to contract into locking engagement with the exterior of a well head. As a yet further alternative a set of radially outwards moving balls may be employed in a mechanical lock, to move into engagement with a feature provided within a bore of the wellhead.

Alternatively, engagement with a well head may be by a portion of the mechanical lock indenting ('biting') into the wall of a bore or an exterior surface of the wellhead. For example, the mechanical lock may comprise one of:

- a set of radially expanding dogs with ridges or teeth for indenting engagement with the wall of a bore (i.e. so called 'slips');
- an expanding split ring with ridges or teeth for indenting engagement with the wall of a bore: and
- a set of radially outwards moving balls for indenting engagement with the wall of a bore.

The mechanical lock may include a secondary unlocking arrangement. The secondary unlocking arrangement may comprise a separate hydraulic system, or a separate part of a hydraulic system, that powers the mechanical lock, for example in the event of failure of the hydraulic system that is normally employed to operate it. The secondary unlocking system may be employed after the disconnection system discussed below has been operated.

The secondary unlocking arrangement may comprise an unlocking ring that can be operated to move an axially moving cam ring of the mechanical lock in the event that it cannot be moved by the intended power source. The unlocking ring moves axially. The unlocking ring may be powered by a separate hydraulic system, or a separate part of a hydraulic system from that used with the axially moving cam ring of the mechanical lock.

The safety module may comprise further features. The safety module provides fluid communication between an umbilical and the perforation and circulation module. In normal use the umbilical provides connection to above the water surface, typically to a floating vessel. This allows supply and return of fluids, supply of hydraulic and/or electrical power and control and sensor data.

Operations from a floating vessel such as, in particular, a dynamically positioned ship prevents the risk of a "drive off", where the vessel accidentally moves away from the wellhead or is forced to move away due to an incident. Such a situation requires emergency disconnection of the vessel from the subsea tooling system, e.g. by severing the umbilical or by severing a connection such: as umbilical to equipment on the vessel; or umbilical to the safety module. Re-establishing a severed connection can be difficult and time consuming.

Conveniently the safety module includes a disconnection system that can allow disconnection and reattachment of an umbilical to the tool without breakage of component parts. Thus, the safety module may comprise two parts: a disconnection part and a base part. The disconnection part connects to an umbilical and has a quick release coupling for connecting to the base. The base accepts the quick release coupling from the disconnection part, includes the mechanical lock and connects to the perforation and circulation module. The disconnection part will contain passages for flow and return of fluids, together with control lines (e.g. electrical and/or hydraulic) to allow operation of the tool as described herein. Appropriate valves (that close on disconnection and are openable on reconnection) can be provided on the base part and the disconnection part. Thus, the disconnection system can allow disconnection without breakage of components, at least on the base part. Preferably disconnection can be without breakage of components on either the base part or the disconnection part. Reconnection of the original disconnection part (and associated umbilical) to the base part can then be readily achieved. Alternatively, a new disconnection part and associated umbilical can be connected to the base part for resumption of operations. For example, if the disconnection part or its associated umbilical has been damaged in a "drive off" incident, The quick release coupling may be hydraulically operated from a floating vessel, via the umbilical. The quick release coupling may comprise a plurality of dogs, typically distributed circumferentially about a surface and operable, for example by means of an axially moving cam ring, to move inwards to engage an outwards directed surface of the base. The axially moving cam ring can be powered hydraulically by a hydraulic system.

The axially moving cam ring and dogs may be formed so that on axial movement of the cam ring to disengage the dogs, the cam ring engages with a hook feature on each of the dogs to positively hold the dogs in the disengaged state. This aids in ensuring successful disconnection in an emergency.

In an alternative arrangement, where an inner surface of the base is to be engaged, the dogs can be arranged to move outwards for locking engagement.

Sealing may be provided between the ends of fluid passageways of the disconnection part and the base that are in fluid communication when the safety module is assembled. Similarly shut off valves may be provided in the base and in the disconnection part, to operate on disconnection, preventing fluids leaking out from the wellbore and supply and return hoses.

For ease of reconnection subsea (for example by use of an ROV), the safety module may include one or more alignment features on at least one of the disconnection part and base part. Alignment features allow fitting of the disconnection part and base part only when in the desired orientation with respect to each other. For example, a projection or "finger" on one part may fit into a corresponding slot or groove in the other.

As a yet further safety feature the safety module may include a secondary disconnection arrangement. The secondary disconnection arrangement may comprise a separate hydraulic system, or a separate part of a hydraulic system, that powers the secondary disconnection arrangement, for example in the event of failure of a hydraulic system that is normally employed to operate it.

The secondary disconnection arrangement may comprise a disconnection ring that can be operated to move the axially moving cam ring of the disconnection system in the event that it cannot be moved by the intended power source. The disconnection ring moves axially. The disconnection ring may be powered by a separate hydraulic system, or a separate part of a hydraulic system from that used with the axially moving cam ring.

After disconnection of the disconnection part of the safety module the remainder of the tool remains mechanically locked into the wellhead. Where reconnection of the disconnection part is not desired, or not possible, the remainder of the tool can still be retrievable from the well head.

For example, where the mechanical lock engages an inside surface (e.g. an abutment profile in the form of grooves) of the well head a Blow Out Preventer (BOP) can be fitted, locking on to an external abutment profile of the wellhead. The base part of the safety module may include a connection that accepts a drill pipe end allowing fluid access to the interior of the tool. In a convenient arrangement, a secondary unlocking system of the mechanical lock can be activated by fluid pressure applied via the drill pipe. A bursting disc or other mechanism that opens under the application of excess pressure can be used to provide access to a separate hydraulic system or part of a hydraulic system from that normally employed to operate the mechanical lock. If an unlocking ring is employed, the fluid pressure may power an unlocking ring that moves an axially moving cam ring to disengage dogs. The fluid may act on the unlocking ring via one or more fluid passageways in the tool that is/are opened following rupture of one or more bursting discs (or opening provided by operation of another pressure operated mechanism) caused by the fluid pressure.

The perforation and circulation module has upper and lower seals for sealing to the inner surface or casing or tubing, typically sealing will be to the inside surface of production casing in an abandoned well. (For convenience the term casing is used generally throughout this document to refer to any tubing located as part of a well bore structure for normal operations.

The seals are spaced apart and will typically be mounted about a mandrel, or each may be mounted to separate mandrels. The mandrel or mandrels comprise piping of the fluid flow paths. The seals can be passive cup type seals or of the various other known 'packer' types used in retrievable downhole tools. For example, inflatable or expandable packers, where controlled hydraulic or mechanical action is used to expand sealing members into sealing engagement with casing walls.

The tools of the first aspect of the present invention include a mechanical lock to the well head. Therefore the upper and lower seals do not have to serve in preventing axial movement of the tool in the wellbore. Operations using the tool (described hereafter) do not require deflation of one or more of the seals to allow fluid passage in the tubing. It can be convenient to make use of seals with reduced mechanical complication, even passive seals that operate without control from above. The known cup seals comprising a resiliently deformable cup shaped member mounted on a mandrel can serve. Two cups, with open ends facing in opposite axial directions, may be provided for each of the upper and lower seals, so that the bi-directional nature of such a seal facilitates the ability to seal and/or test from above and below.

The perforation and circulation module has a supply fluid flow path through the upper and lower seals. In use this can supply fluid to the wellbore below the seal made to the production casing by the lower seal. The return fluid flow path is provided from between the upper and lower seals. Conveniently the supply and return fluid flow paths can include a pipe in pipe arrangement within a mandrel mounting the upper seal. For example an outer pipe terminating between the upper and lower seals provides return fluid flow from between the seals. An inner pipe extends further, continuing through a mandrel mounting the lower seal to provide supply fluid flow.

The perforation and circulation module has at least one upper perforating device, mounted between the upper and lower seals. The upper perforating device or devices can be of the conventional type, perforating 'guns' mounting explosive charges that are activated to make holes through tubing or a casing into one or more annuli but alternative devices which perforate casing or casings may be provided. Where 'guns' are used these may be detonated electrically but preferably hydraulically, and the tool will include porting for this purpose.

At least one lower perforating device, is provided, below the lower seal. Lower perforating devices can be of the same type as used for the upper perforating devices e.g. perforating guns. The at least one lower perforating device is mounted below the lower seal. For typical operations making use of the tool the lower perforating device(s) is/are mounted at some distance below the lower seal, typically at least 150 m below the lower seal. This can be arranged by suspending the lower perforating device(s) on flexible lines) from a fitting at or near the lower seal. Typically wire ropes suspend the devices and hydraulic control tubing conveys fluid to activate the detonation but alternative electrical means may also be used via electrical conductors.

The tool of the first aspect of the invention may comprise other features. For example the tool may be provided with a cement wiper system. The cement wiper system may comprise a wiper plug, detachably mounted below the lower seal of the perforation and circulation module. In use the wiper plug detaches from the tool and descends in advance of a flow of cement slurry, clearing fluid and debris from the bore (casing) the tool has been inserted into. The wiper plug avoids dilution or "fingering" (the cement separating into flows that are separated by well fluids such as water). The wiper plug can be sized to wipe or to pass close to the walls of the production casing as it descends. The wiper plug can make use of one or more resiliently deformable members, for example circumferential ribs, to provide good contact with the walls as it descends.

The wiper plug may be attached to the tool by a frangible connection, that breaks when the wiper system is operated. Alternatively, the wiper plug may be held in position by a mechanical connection that releases on receipt of a control signal or when pressure of descending fluid in the tool causes release of the mechanical connection.

In a convenient arrangement the wiper plug has a passage therethrough that forms part of the supply fluid flow path. The wiper system may be operated by a dropping ball mechanism. The passage forming part of the fluid supply path may include a seat for a ball. In such an arrangement a ball is provided, for example within the safety module, or in a ball holding unit attached to the safety module. On operation of a signal such as a hydraulic control signal, the ball is released to fall through the tool, typically along the supply fluid flow path, and pushed by fluid being pumped from above. The ball rests in the seat of the wiper plug resulting in a build up of pressure until the wiper plug detaches and descends.

The tool according to the first aspect of the invention is for cementing an annulus in a subsea oil or gas well. Typically the well will be sealed in the production bore by a deep cement plug. The rest of the production bore and annuli surrounding it will be filled with fluid (water, well products and/or fluids from well operations).

Thus according to a second aspect the present invention provides a method for cementing an annulus in a subsea oil or gas well, the method comprising:

a) providing a tool in accordance with the first aspect of the invention as described herein:
b) deploying the tool, attached to an umbilical, from a surface vessel or rig mounted on the seabed, into a wellbore via a wellhead;
c) operating the mechanical lock to connect the tool into sealing engagement with the well head;
d) operating the at least one lower perforation device, to perforate wellbore casing, thereby allowing fluid communication with an annulus;
e) operating the at least one upper perforating device to perforate wellbore casing between the upper and lower seals, thereby allowing fluid communication with the annulus;
f) cleaning the annulus by at least one of:
   passing fluid from, and back to, the surface vessel or rig through the umbilical, the supply fluid flow path, into the annulus and returning via the return fluid flow path and the umbilical, and
   passing fluid from, and back to, the surface vessel or rig through the umbilical, the return fluid flow path, into the annulus and returning via the supply fluid flow path and the umbilical;
g) charging the annulus with cement by:
   passing a charge of cement slurry followed by a tail fluid from the surface vessel or rig through the umbilical, the supply fluid flow path and into the annulus; or by
   passing a charge of cement slurry followed by a tail fluid from the surface vessel or rig through the umbilical, the return fluid flow path and into the annulus;
h) allowing the cement to set;
i) cleaning between the upper and lower seals by operating the diversion means in the supply fluid flow path to redirect fluid supplied to the supply fluid flow path to a space defined between the upper and lower seals, and at least one of;
   passing cleaning fluid from, and back to, the surface vessel or rig through the umbilical, the supply fluid flow path, through the diversion means and returning via the return fluid flow path and the umbilical, and
   passing cleaning fluid from, and back to, the surface vessel or rig through the umbilical, the return fluid flow path, through the diversion means and returning via the supply fluid flow path and the umbilical; and
j) unlocking and removing the tool from the well head.

Where the diversion means comprises a valve in the supply fluid flow path, it is operated to redirect fluid supplied to the supply fluid flow path to the space in-between the upper and lower seals at step i) above.

Where non passive seals are employed the method will also include operating the seals when the tool is deployed into the wellbore (e.g. at step b) above), to provide sealing to production tubing or casing before the seals are required to direct fluid flow.

The method may also include pressure testing for safety reasons at various stages of the operation. For example, after the lower perforation devices have been operated the annulus may be pressurized (by a fluid such as water) pumped down the umbilical and through the supply fluid flow path. A loss of pressure would indicate the annulus has a leak path and so is not suitable for the proposed cementing operation. Pressure testing may also be carried out between the upper and lower seals (e.g. making use of the return fluid flow path to supply fluid pressure). After cement has set in the annulus, pressure testing can show that the barrier of cement is complete, without a leakage path.

In general pressure testing can be carried out by applying fluid pressure from a surface vessel or rig down a conduit in the umbilical and monitoring for a loss of pressure at the vessel or rig. Alternatively, or additionally, the tool may be provided with pressure sensors and signal means to measure downhole pressures.

The charge of cement slurry is typically calculated on the basis of the anticipated volume of the annulus being filled, between the lower and upper perforations made by the respective lower and upper perforation devices. Typically a length of about 152 m (500 ft) may be provided between the sets of perforations and the cement slurry charge is intended to fill about at least 100 m (328 ft). The cement slurry charge is delivered into the annulus by following it with a suitable 'tail fluid'. The tail fluid and fluids used before or after the cement slurry for cleaning or flushing operations are typically water or water based, e.g. seawater.

Where the tool is provided with a cement wiper system as described herein then step g) in the method as described above can be carried out by passing cement slurry charge and tail fluid from the surface vessel or rig through the umbilical, the supply fluid flow path and into the annulus. The cement wiper plug is deployed ahead of the charge of cement slurry to avoid dilution and clear a path for the cement. The wiper plug will descend to the level of the apertures through tubing or casing made by the lower perforating device(s) and allow the cement to pass into the annulus and fill it to the extent desired.

The method of cementing an annulus is typically employed when a well is to be sealed closed for permanent abandonment. The method of cementing is typically carried out in well with a cement plug already present at depth in the production bore, allowing insertion of the tool without substantial loss of fluid from the production casing. In such situations a cement plug across all the layers of casing is mandatory.

Cementing to form a barrier in the central casing (production bore) can be carried out as follows.

After the cement charge in the annulus is set and either before or after the space between the upper and lower seals has been cleaned, a further charge of cement slurry followed by a tail fluid can be pumped down the umbilical and through the supply fluid flow path into the production casing that forms the central bore of the well. As an alternative a single charge of a cement slurry sufficient to fill both the annulus and the central bore of the well to the desired extent may be supplied. i.e. the charge delivered is calculated to fill the production casing up to a desired level below the lower seal of the tool. Where such an arrangement is used, pressure testing of the cement plug in the annulus and the cement plug in the central bore can be carried out together.

Thus in a third aspect the invention also provides a method of cementing a subsea oil or gas well to provide a permanent barrier across the well before wellhead removal and abandonment.

To assist in avoiding dilution of the cement by fluid in the umbilical, the valve in the supply fluid flow path can be set to direct redirect fluid supplied to the supply fluid flow path to between the upper and lower seals, allowing the bulk of the fluid passing down the umbilical, in advance of the cement slurry charge, to pass down the umbilical and be redirected back up the umbilical via the return fluid flow path. This may be a substantial length e.g. a water depth of 120 to 180 m (400 to 600 ft) is typical in the UK sector of the North Sea. The valve is set to allow normal flow down the fluid flow path to below the lower seal before cement slurry arrives at the tool. The desired quantity of cement slurry is then charged into the central bore of the well. As the fluid remaining in the central bore may not have an escape route, forming a satisfactory plug of cement may be aided by removing the tool from the wellbore as this final charge of cement slurry is delivered. Alternatively where an expandable packer is used at the lower seal a return path may be established by deflating or retracting the lower seal.

Where the tool has a lower seal that employs inflatable or expandable packers (actively controllable by the operator of the tool) then the cleaning following the charge of cement slurry may be achieved in an additional or alternative fashion. After deflating or collapsing the lower seal, cleaning fluid can be circulated through the supply fluid flow path to below the lower seal (above the cement in the production casing) with a return to the surface available past the lower seal and via the return fluid flow path in the tool. The use of a lower seal that can be deflated or collapsed in this way can aid in avoiding cementing the tool into the production casing.

Pressure testing of the cement plug in the production casing and/or the central bore of the well can then be carried out. The wellhead may then be removed, typically the casings are severed at some depth, typically about 5 m (15 ft) below the seabed surface to leave no structure vulnerable to damage by collision with e.g. fishing gear.

The methods of the invention may extend to cementing more than one annulus in a wellbore. When a second annulus is to be cemented, the tool according to the first aspect of the invention can be fitted with:

- at least a second upper perforating device, mounted between the upper and lower seals, for perforating casing or tubing after a first annulus is sealed by cement; and
- at least a second lower perforating device, mounted below the lower seal, for perforating casing or tubing after a first annulus is sealed by cement.

These second perforating devices can be used after cementing the first annulus to perforate through to a second annulus, outside the first and allow a cementing operation such as described in steps f) to h) above. Appropriate pressure testing can be carried out at each stage, for example after se of the second lower perforating device to determine that the second annulus does not have a leak path that would allow loss of cement slurry to the surroundings.

To avoid the second perforating devices having to cut through cement in the first annulus both the upper second perforating device may be positioned above the first and the second lower perforating device may be positioned below the first.

After cementing a second annulus the cleaning and unlocking operations i) and j) described above may be carried out, or more typically cementing the central tubing or casing is carried out as described above for obtaining a cement barrier across the whole of a well.

In a preferred sequence of operations when two annuli and the central bore of a well are to be cemented the cementing procedures of the method may be carried out by using the following particular options for the method steps.

After the first annulus has been cleaned (e.g. as in step f) above), the charge of cement slurry is delivered by passing cement slurry followed by a tail fluid from the surface vessel or rig through the umbilical, the return fluid flow path and into the annulus. The cement slurry charge is held in position within the annulus by controlling (balancing) the fluid pressure in the production casing via the supply fluid flow path. Supplying the cement charge in this way allows use of a cement wiper system as discussed below:

After cleaning between the upper and lower seals making use of the diversion means and allowing the cement to set (as in steps h), i) above) the pressure in the first annulus can be tested.

The second perforating devices are used in the same way as the first, to establish a flow path through the second annulus.

The second charge of cement slurry is delivered by passing cement slurry followed by a tail fluid from the surface vessel or rig through the umbilical, the return fluid flow path and into the second annulus. The charge delivered is calculated to be sufficient not only to fill the second annulus to the desired extent but also to fill the production casing up to a desired level below the lower seal of the tool. Where the tool is fitted with a cement wiper system the wiper plug is deployed in front of the second cement slurry charge.

After cleaning between the upper and lower seals making use of the diversion means and allowing the cement to set (as in steps h), i) above) the cement is allowed to set.

Pressure in the second annulus and production casing can then be tested.

Conveniently the diversion means employed comprises a valve in the supply fluid flow path, operable to redirect fluid supplied to the supply fluid flow path to the space in-between the upper and lower seals. In an alternative arrangement, where the tool has a lower seal that employs inflatable or expandable packers (actively controllable by the operator of the tool) then the cleaning following the second charge of cement slurry may be achieved in a different fashion. After deflating or collapsing the lower seal, cleaning fluid can be circulated through the supply fluid flow path to below the lower seal (above the cement in the production casing) with a return to the surface available past the lower seal and via the return fluid flow path in the tool. The use of a lower seal that can be deflated or collapsed in this way can aid in avoiding cementing the tool into the production casing.

DETAILED DESCRIPTION OF THE DRAWINGS

Figure 1:
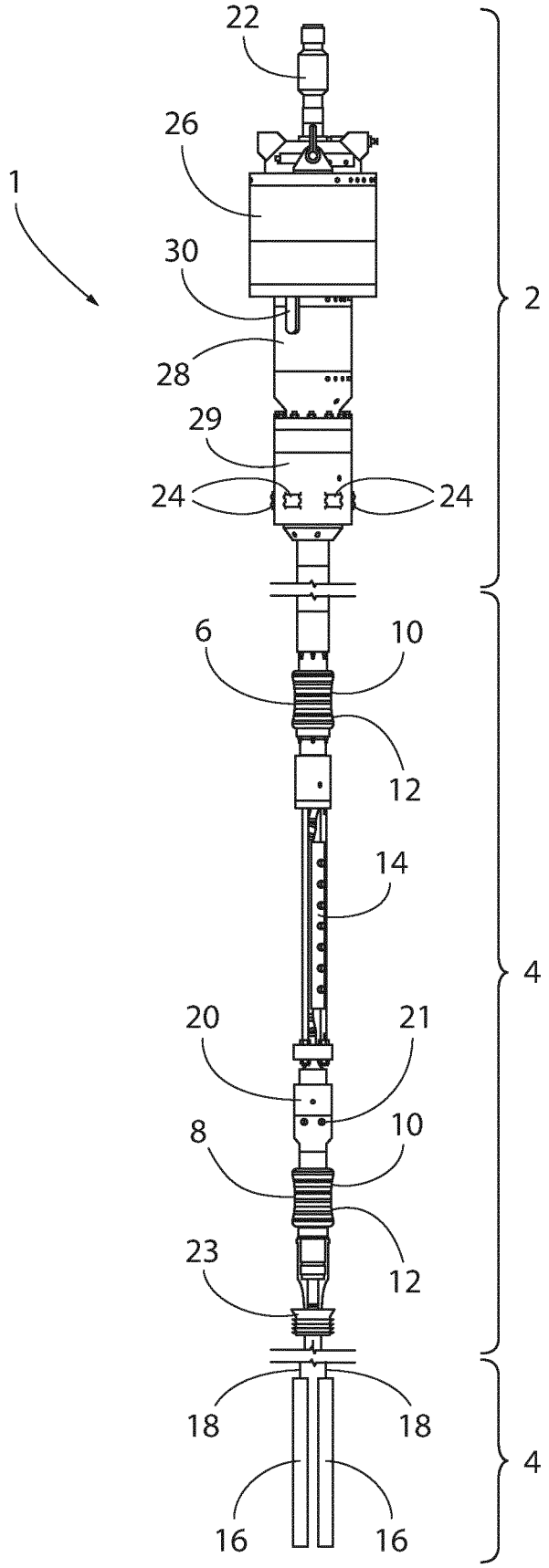
FIG. 1 shows in schematic elevation a tool for cementing an annulus.

A tool for cementing an annulus and for methods of cementing a subsea oil or gas well to provide a permanent barrier is shown in schematic elevation in FIG. 1. Umbilical connection from the top of the tool to a surface vessel or rig are not shown, for clarity. Breaks are shown between parts 2, 4 and the lower end of part 4, to allow showing the whole tool in one view.

The tool 1 includes a safety module 2 and a perforation and circulation module 4. The perforation and circulation module 4 includes upper and lower seals 6,8 each having two passive cup seal members 10,12 in this example. Upper perforating devices, in this example perforating guns 14 (only one visible in this view) are mounted between seals 6,8. Lower perforating devices in this example perforating guns 16 are suspended (at some distance) below the lower seal 8 by cables and/or hydraulic control lines 18.

A cross-over valve 20 (in this example a sliding sleeve valve) is mounted between the seals 6,8 and has apertures 21 that can allow passage of fluid when the valve is opened. Also visible in FIG. 1 is a ball holding unit 22 which is part of a cement wiper system that includes wiper plug 23.

In this example the safety module includes a disconnection part 26 joined to a base part 28. The base part 28 includes a wellhead connector section 29. The wellhead connector section 29 includes a mechanical lock whose retractable dogs 24 are visible in an expanded (locking) position in this figure.

The disconnection part 26 includes alignment projections 30 (only one visible in this view, typically at least two are used). The projection 30 sits in a groove of the base part 28.

Figure 2:
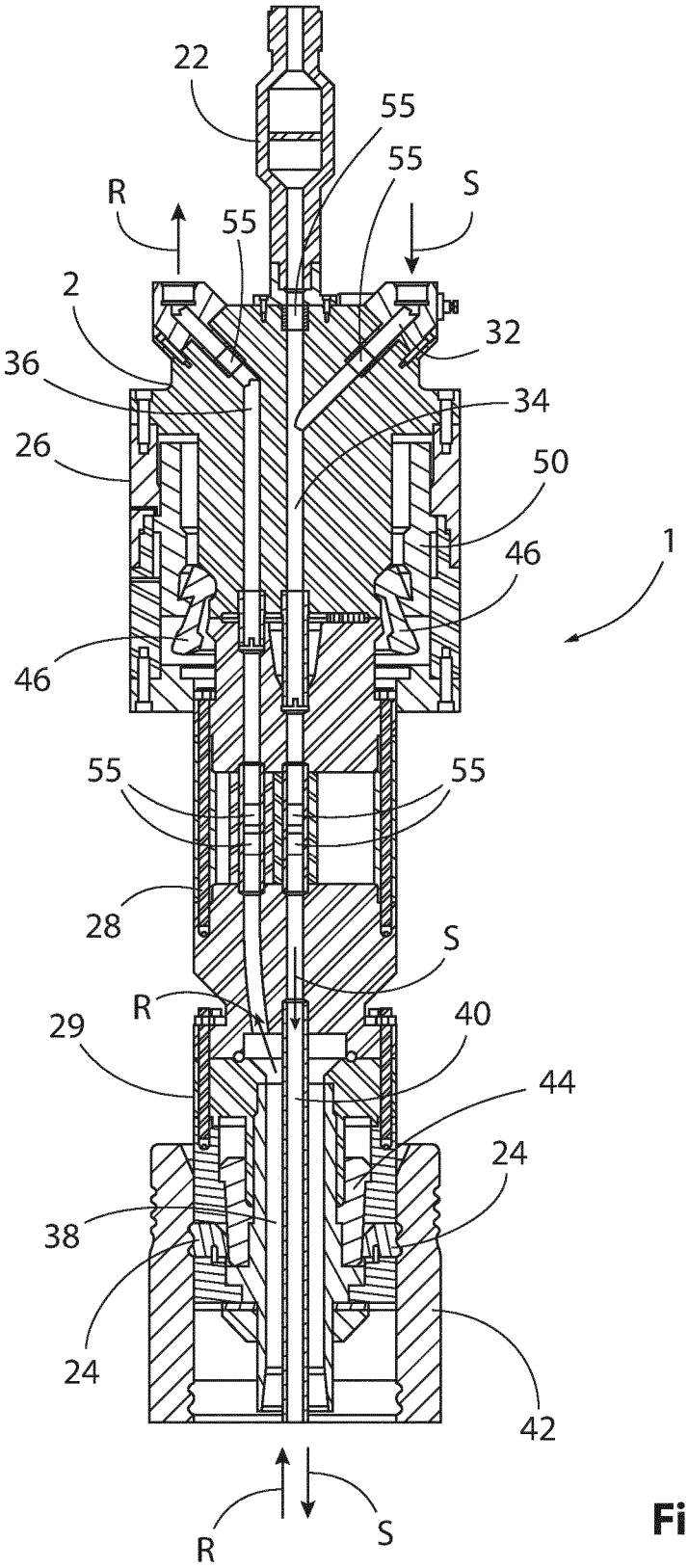
FIG. 2 shows in schematic cross section the interior of the safety module of the tool depicted in FIG. 1.

FIG. 2 shows in schematic cross section the interior of the safety module 2 of the tool depicted in FIG. 1. Parts are numbered the same as in FIG. 1.

Visible in the interior of the safety module 2 is a bore 32 leading to a central bore 34 that passes down the centre of the tool and continues to the perforation and circulation module (not shown in this figure). These bores 32, 34 are part of the supply fluid flow path for supply of fluid, including cement slurry, from an umbilical, in use of the tool. The normal direction of flow is suggested by arrows S, but as described herein the flow direction may be reversed in some operations. Ball holding/releasing unit 22 is in communication with the supply fluid flow path so that a ball released from the unit 22 will pass down the supply fluid flow path.

Also shown is a bore 36 that constitutes part of a return fluid flow path, for return of fluids back up through an umbilical in use. The flow path from bore 36 continues as an outer pipe 38 surrounding an inner pipe 40 that is a continuation of bore 34. The normal direction of flow is indicated by arrows R, but as described herein the flow direction may be reversed in some operations.

Outer pipe 38 ends at upper seal 6 (FIG. 1) whilst inner pipe 40 extends to below lower seal 8 (FIG. 1).

As depicted in FIG. 2 the dogs 24 of a mechanical lock are engaging with corresponding grooves on the interior bore of a typical subsea well head housing 42, positively locking the tool 1 to the wellhead 42, in particular acting to prevent upwards or downwards (i.e. axial) movement. The dogs are operated by a hydraulically driven cam ring 44, and are releasable if the ring moves upwards.

In this figure the disconnection part 26 of the safety module is shown unlatched and ready for release from the base part 28. Dogs 46 are shown held away from engagement with circumferential groove 48 by hydraulically driven cam ring 50 which includes a projection 52 engaging with hook features 54 on the dogs 46. (See magnified part view FIG. 2*a*). On separation of the disconnection part 26 from the base part, appropriate fail-safe closed valves 55 will act to seal the fluid flow paths and non-return valves will act to seal hydraulic control lines where required. In this example, in the base disconnection part 26, two tandem fail-safe valves are provided in each flow-path.

Figure 2A:
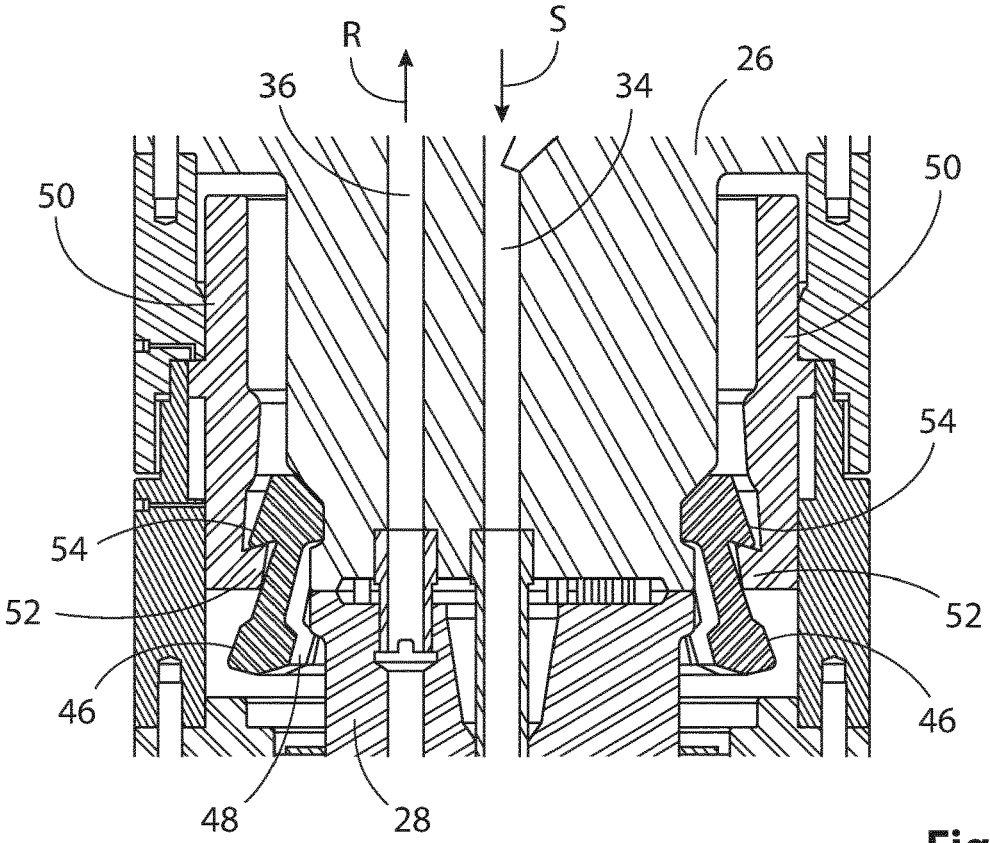
FIGS. 2*a* and 2*b* shows in schematic cross section details of the interior of the safety module of the tool depicted in FIG. 1.
Figure 2B:
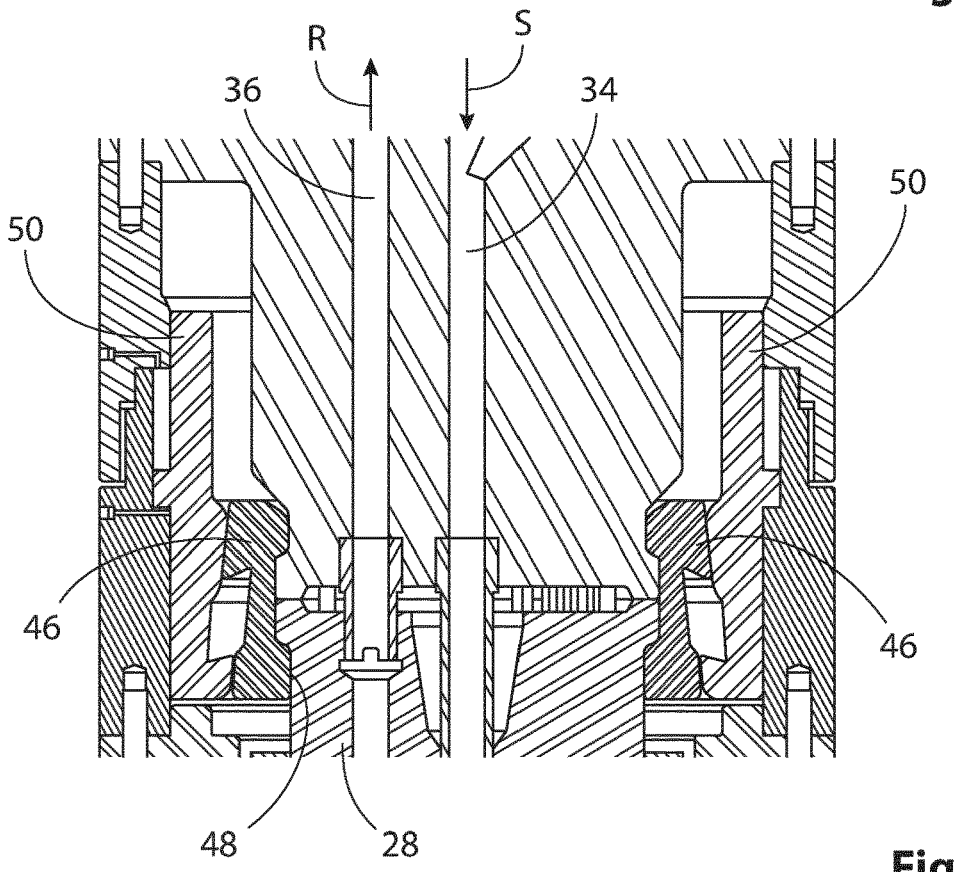

In normal use the cam ring 50 is in a lowered position to force dogs 46 into groove 48, as shown in magnified detail of FIG. 2*b*.

Figure 3:
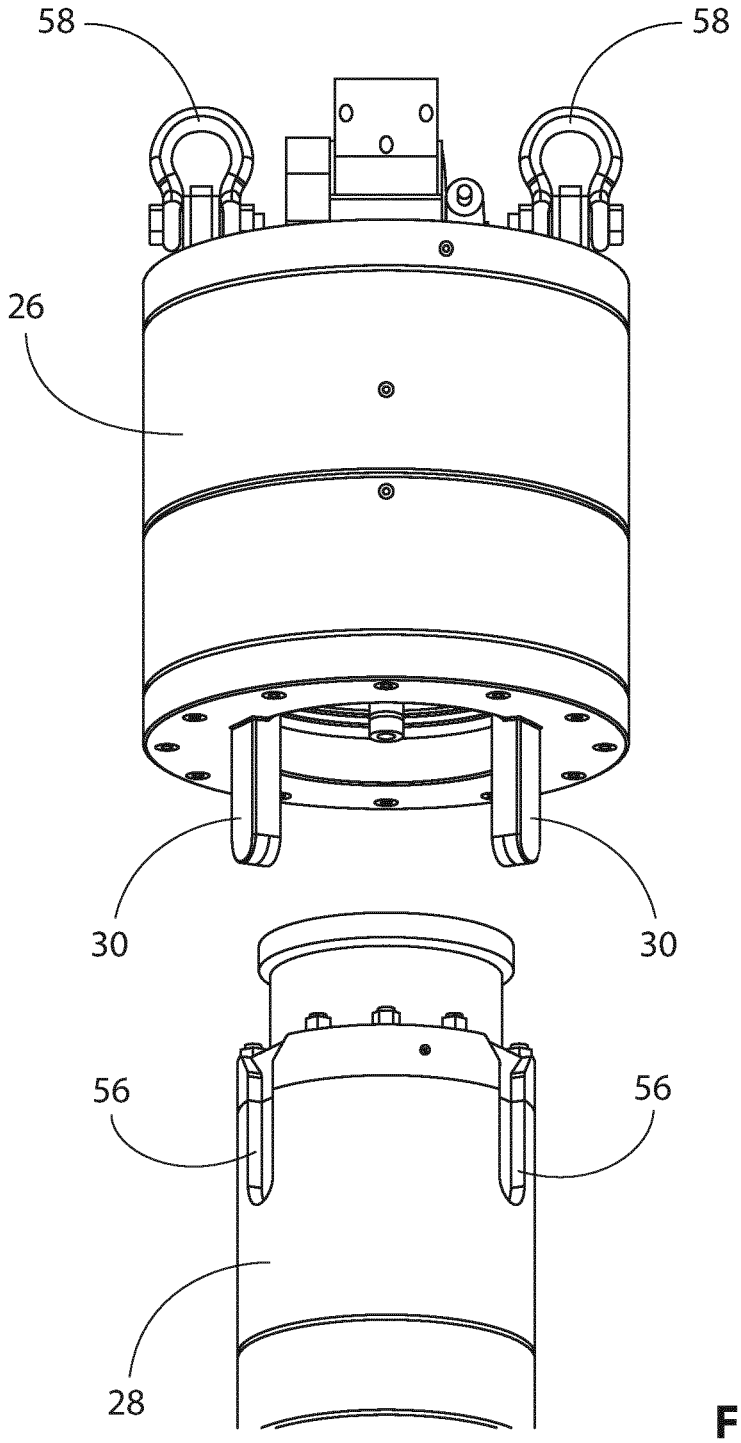
FIG. 3 shows in partial schematic perspective the parts of a safety module.

FIG. 3 shows in schematic perspective the parts of disconnection part 26 and base part 28 separated from each other. In this view the projections 30 of disconnection part 26 and corresponding grooves 56 on base part 28 can be seen. On connection or reconnection of parts 26 and 28 the projections 30 and grooves 26 ensure fitting together in the correct orientation to allow alignment of parts such as the bores for fluids shown in FIG. 2. Pad eyes 58 are shown in this figure, for use in connecting lifting members, e.g. ropes constructed from wire or other materials, cables etc. for lifting and lowering the tool.

Figure 4A:
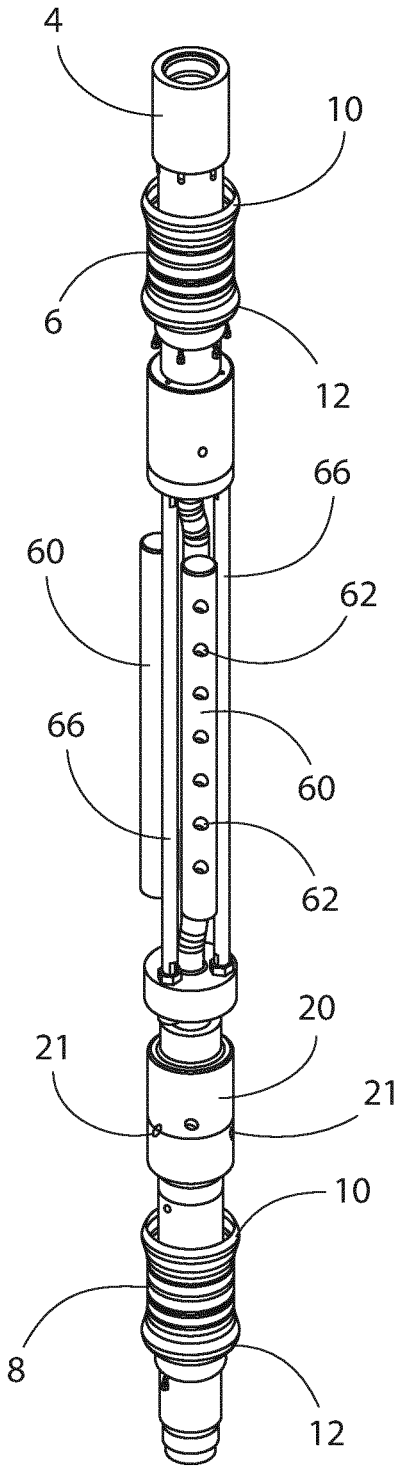
FIGS. 4*a* and 4*b* show parts of a perforation and circulation module in schematic perspective views.
Figure 4B:
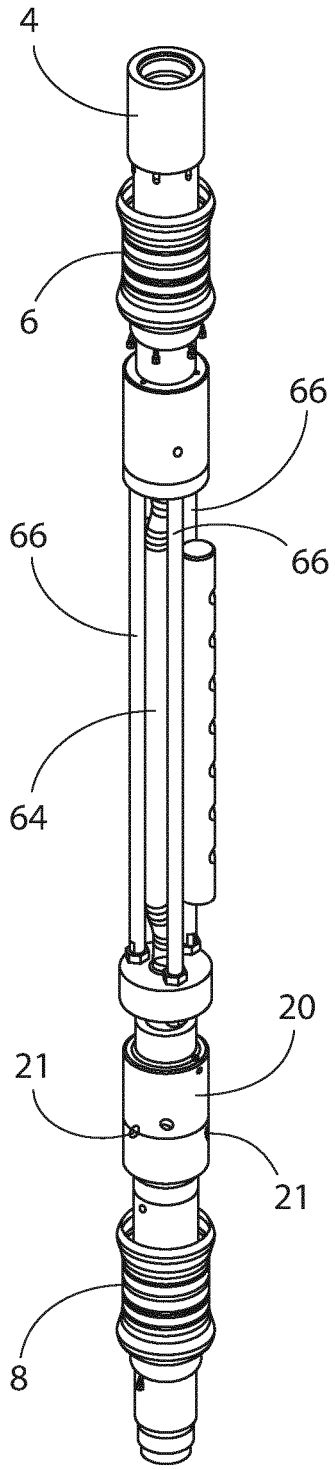

FIGS. 4*a* and 4*b* show in schematic perspective the major part of the perforation and circulation module 4 of the tool depicted in FIG. 1. The part in FIG. 4*b* is rotated with respect to the view of FIG. 4*a* to provide two viewing angles.

As can be seen in FIG. 4*a* two upper perforating guns 60 (the perforating devices employed in the example) are mounted between seals 6,8. The guns 60 include a number of apertures 62 for directing products and energy from detonation of explosives outwards to perforate casings downhole. As can be seen more easily in FIG. 4*b* a pipe section 64, which is a continuation of pipe 40 shown in cross section FIG. 2 passes by the upper perforating guns 60 and through the mandrel mounting lower seal 8. Pipe section 64 is part of the supply fluid flow path and is in fluid communication with outlets 21 of cross-over valve 20, when the valve is opened. Hollow studs 66 connect the upper and lower parts of the perforation and circulation module 4 and one or more can carry hydraulic lines. For example, for operating cross-over valve 20 and lower perforation guns (not shown in these figures). In general, the hollow studs 66 may carry hydraulic lines, electrical signal and/or power lines in some examples of the tool.

Figure 5A:
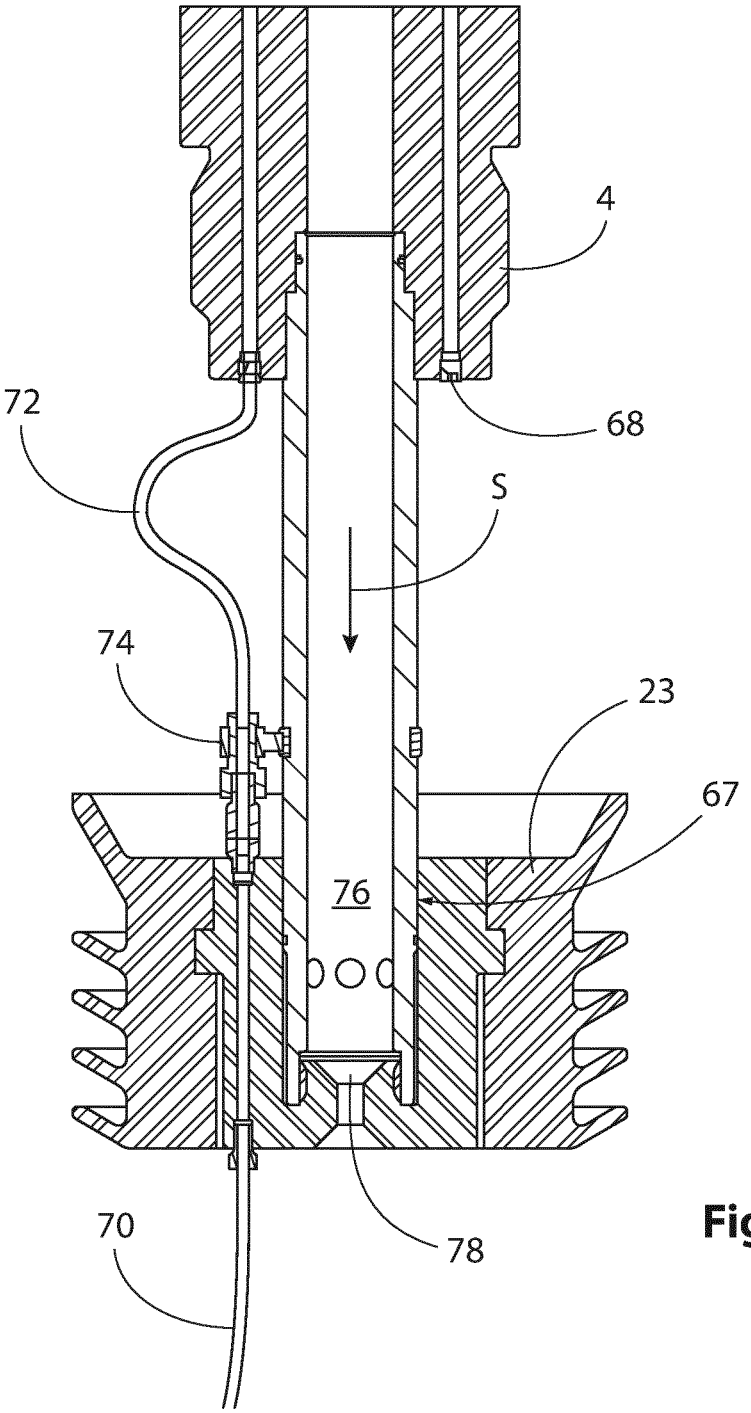
FIGS. 5*a* and 5*b* show in schematic cross section parts of a wiper plug arrangement.
Figure 5B:
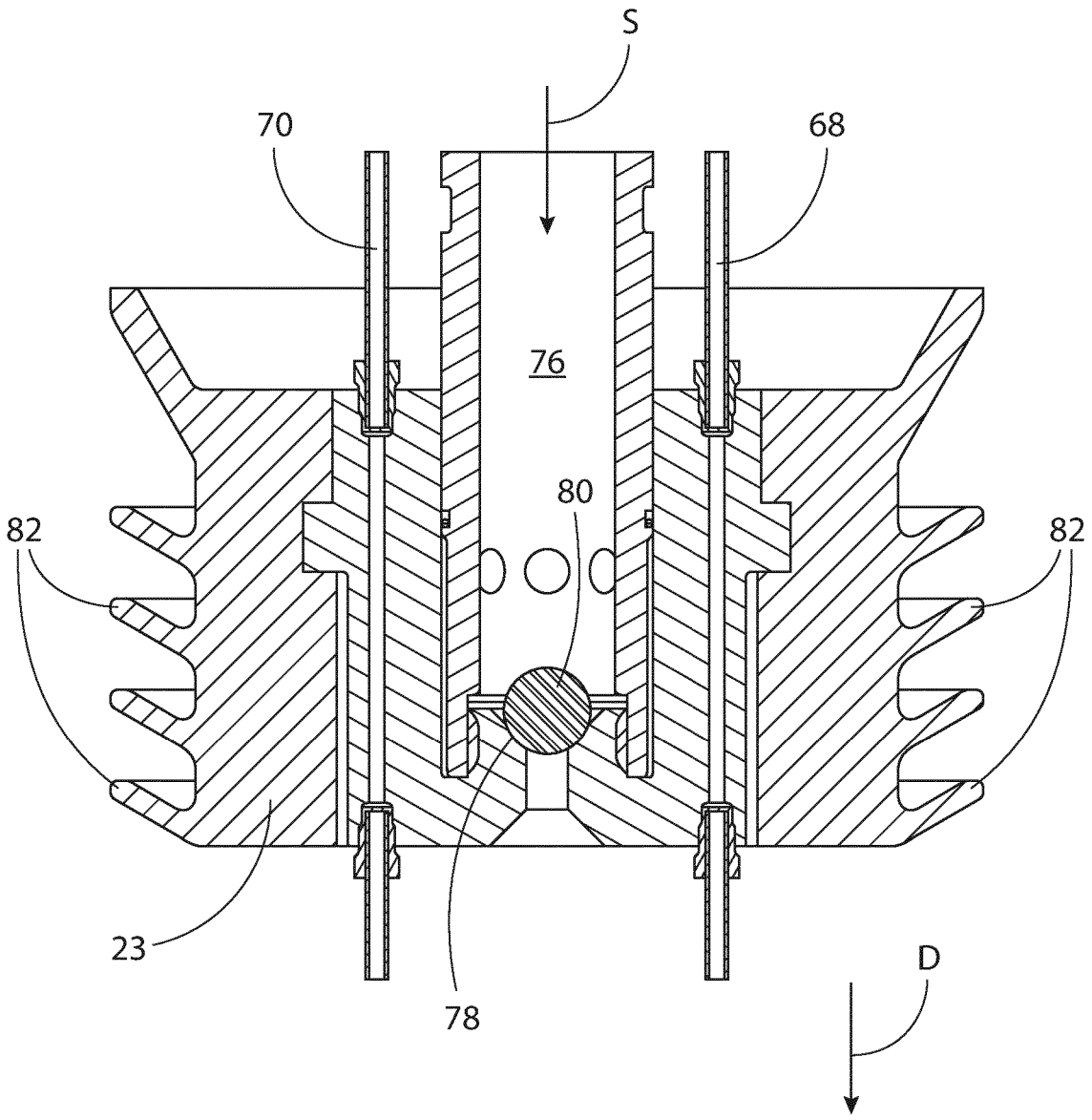

FIG. 5*a* shows in cross section schematic detail a wiper plug arrangement typically made of flexible, e.g. elastomeric, material fitted below the lower seal 8 of a perforation and circulation module. Wiper plug 23 is attached by a frangible connection 67 to the bottom end of the perforation and circulation module 4. Hydraulic control lines 68 and 70 (for firing lower perforation guns—see FIG. 1) pass through the body of the wiper plug 23. Only line 70 is fully shown in FIG. 5*a* but both are shown in FIG. 5*b* (see detail in FIG. 5*b*). The lines 68 and 70 include some "slack" 72 to accommodate axial travel of couplings 74 that will release when the wiper plug 23 detaches and descends away from the perforation and circulation module 4. Passing through the wiper plug 23 is a passage 76, part of the supply fluid flow path S, through which fluids, including cement slurry can pass. The passage 76 includes a seat 78 for a ball that is dropped from ball holding/releasing unit 22 (FIG. 1).

Detail view FIG. 5*b* shows a ball 80 that has been dropped from ball holding/releasing unit 22 situated in seat 78. The ball 80 seals passage 76. Therefore, when fluid flow S is supplied the pressure causes wiper plug 23 to detach and descend (direction D). The circumferential ribs 82 are flexible and sized to fit close to/in contact with the inner surface of a production casing. Thus, when the plug 23 descends in the casing driven by the cement slurry or other fluid above it, it sweeps debris out of the way and acts to avoid unwanted mixing between fluid being delivered and fluid already in the bore of a well.

FIGS. 6*a*, 6*b*, 6*c*, and 6*d* show schematically in cross sections flow paths for cementing operations and fluid circulating procedures. The well casing lengths are not to scale, but are greatly shortened to allow viewing of lower perforations in the figures.

Figure 6A:
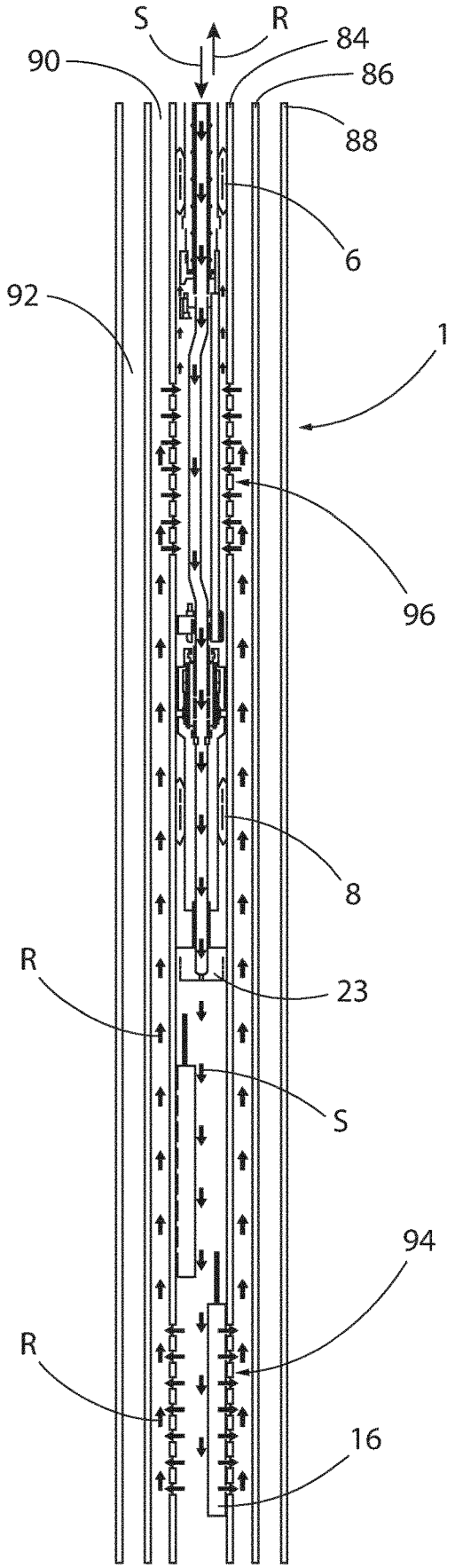
FIGS. 6*a* to 6*d* show in schematic cross sections fluid flow paths in a well bore fitted with a cementing tool.

In FIG. 6*a* a tool 1 (like that of FIG. 1) is located in a production casing 84 of a well with two further casings 86 and 88 creating two annuli, inner annulus 90 and outer annulus 92. One or more lower perforating guns 16 have made lower perforations 94 in casing 84. One or more upper perforating guns (not shown for clarity, but located between upper and lower seals 6,8) have made upper perforations 96 in casing 84. The perforations 94 and 96 allow fluid circulation. As indicated by arrows in FIG. 6*a* a supply fluid flow path allows fluid flow S (of cleaning fluid such as seawater) to be sent from an umbilical through the supply fluid flow path in the tool 1, including through wiper plug 23, down the production casing 84 and through lower perforations 94. The fluid returns in flow R as suggested by arrows from the lower perforations 94, up through inner annulus 90, through upper perforations 96 to between seals 6,8 and back toward the surface by the route through the upper part of tool 1 depicted in FIG. 2. When carrying out a cleaning operation the fluid flows depicted can be reversed.

Figure 6B:
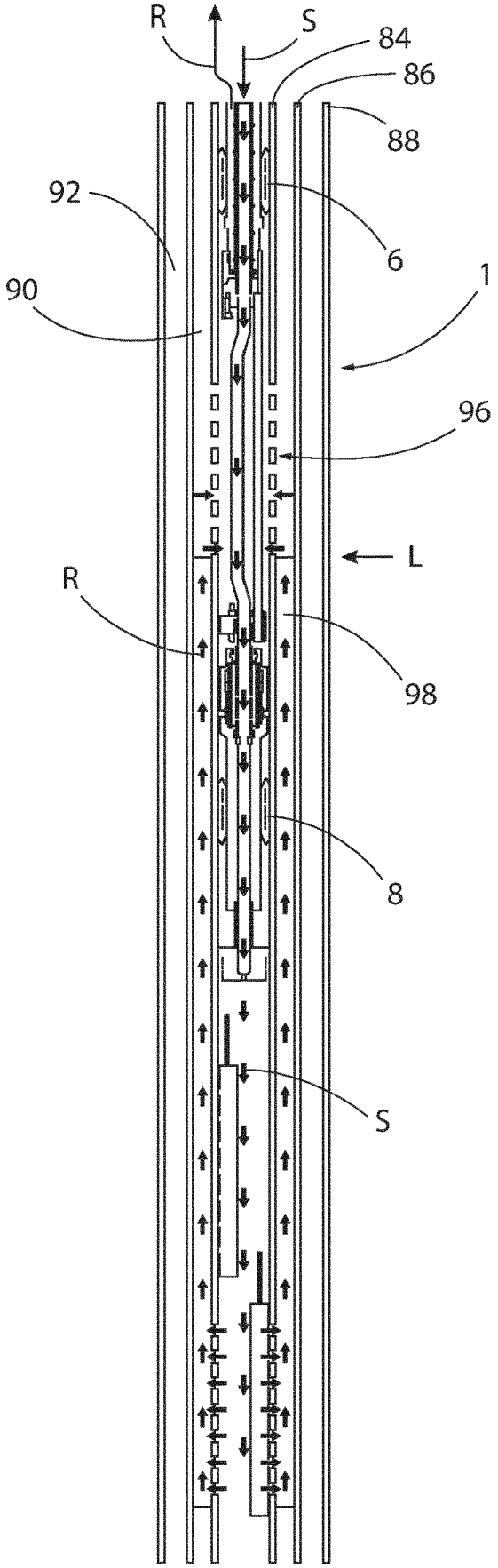

In FIG. 6*b* the same fluid flow paths depicted in FIG. 6*a* are used to deliver cement to the inner annulus 90, which is filled with a cement slurry charge 98 to a maximum height level L below that of the upper perforations 96. The production casing 84 is substantially freed of cement by following cement charge 98 with a tail fluid (such as seawater). Cement charge 98 is allowed to set following which pressure testing can be undertaken. If the outer annulus 92 is not present, or if filling it with cement is not required, then cementing operations can continue by supplying a further charge of cement slurry followed by a tail fluid pumped down an umbilical and through the supply fluid flow path into the production casing that forms the central bore of the well.

As an alternative (the flow path used to fill the inner annulus can be the reverse of that depicted, with cement charge 98 supplied in the direction R.

Figure 6C:
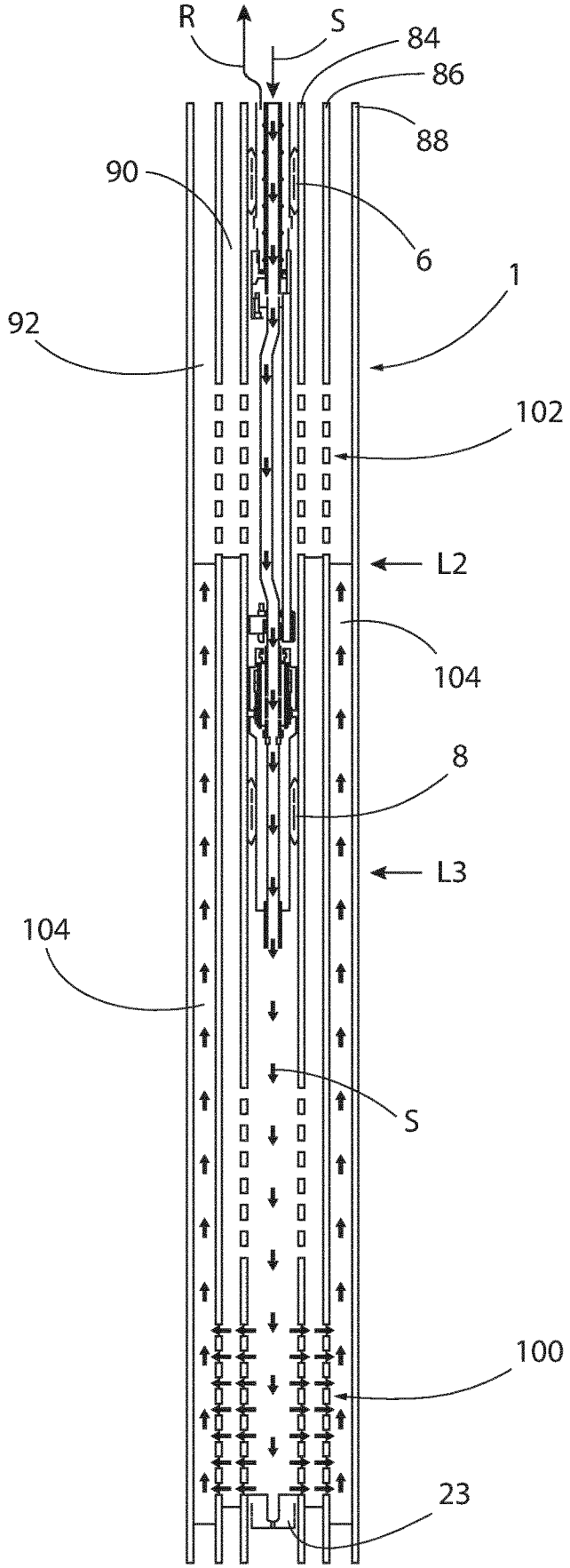

In FIG. 6*c* the cementing of the second annulus 92 is depicted. After perforating through both the casings 86 and 88 with one or more second lower perforating gun(s) the perforations 100 allow access to the second annulus 92. Similarly, one or more second upper perforating gun(s) have made perforations 102 through to the second annulus between the seals 6,8. Cementing in the second annulus 92 is made, in this example, with the use of the cement wiper plug 23. After dropping a ball (FIG. 5*b*) to sit in the seat of the wiper plug 23 a second charge of cement slurry has been passed down the supply fluid flow path. This flow S has detached the wiper plug which is pushed to below perforations 100, cleaning the bore of the production casing 84. The second cement charge 104 fills second annulus 92 up to level L2 below upper perforations 102. Conveniently cementing the bore of production casing 84 is carried out by applying a cement 104 charge that also fills that bore, at least below the bottom seal 8 of the tool to maximum height level L3.

Figure 6D:
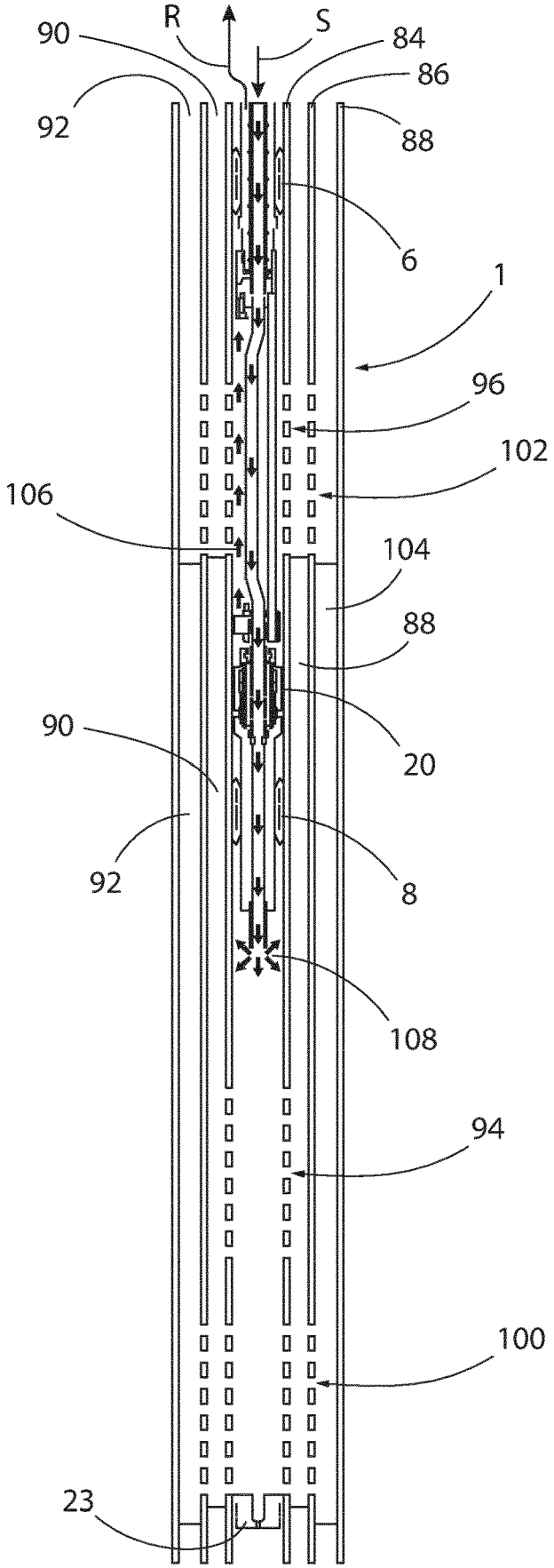

In FIG. 6*d* the use of the cross-over valve 20 in cleaning or flushing the production bore of casing 84 is illustrated. Operating cross-over valve 20 diverts some fluid flow back into the space between seals 6 and 8. In this example as well as diverted flow 106 from supply fluid flow S, the valve 20 also continues to allow flow 108 to below lower seal 8. This arrangement of flows cleans between seals 6 and 8 and prevents debris such as set/setting cement slurry obstructing removal of the tool upwards.

If the lower seal 8 in FIG. 6*d* is an expandable packer having an expandable seal element, the seal element can be relaxed to allow flow past the seal to wash out cement from below seal 8. Such an arrangement of flows can clean between seals 6 and 8 and below seal 8. This can prevent debris such as set/setting cement obstructing removal of the tool upwards.

Figure 7A:
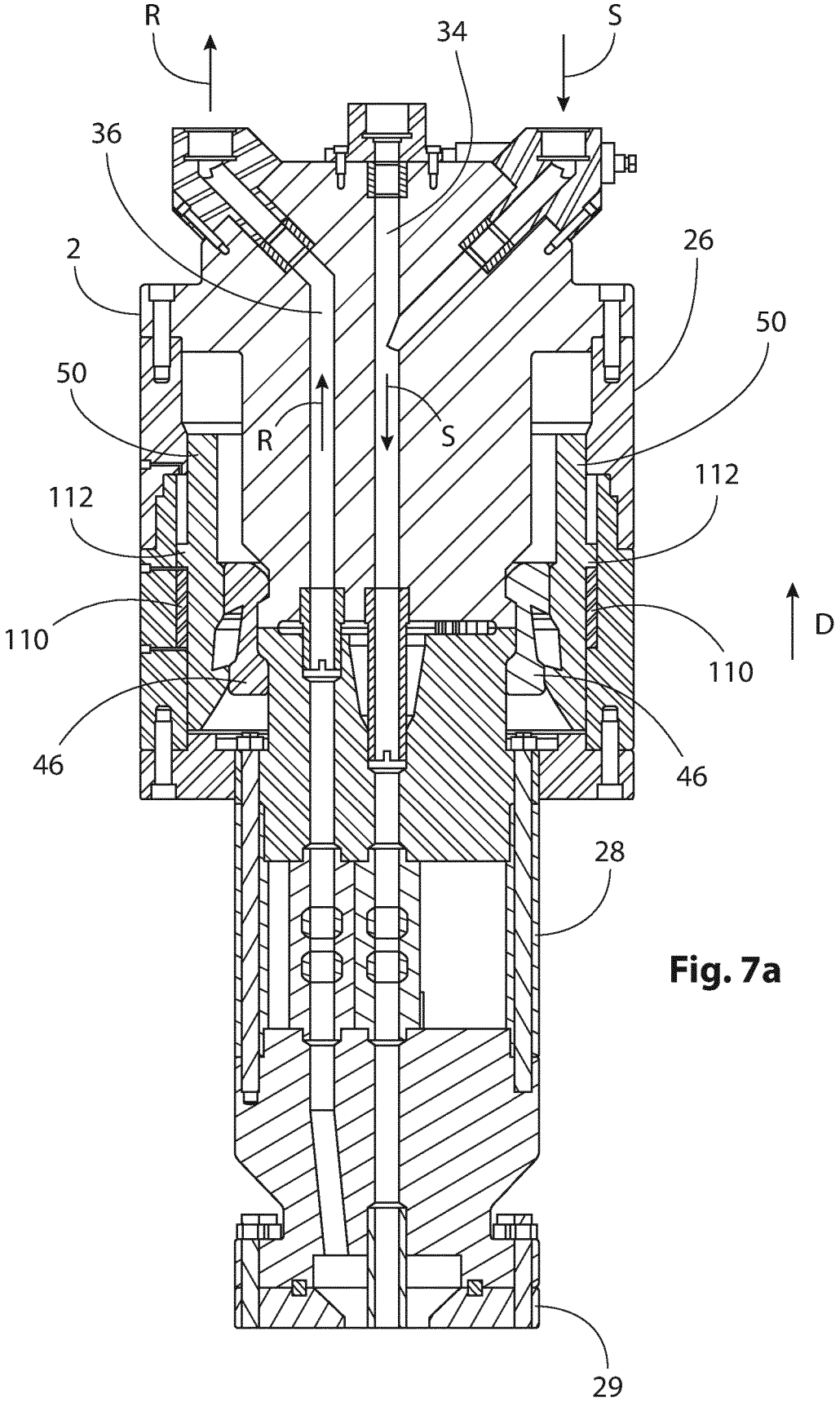
FIGS. 7*a* and 7*b* show in schematic cross sections parts of a safety module.

FIG. 7*a* shows in schematic cross section the interior of a safety module 2, similar to that shown in FIGS. 2, 2*a* and 2*b*.

In FIG. 7*a* the dogs 46 are held in the locked position by axially moving cam ring 50. Therefore, the disconnection part 26 is in locking engagement with the base part 28. In this example the quick release coupling of the disconnection system also includes a secondary disconnection arrangement including disconnection ring 110 placed around the circumference of axially moving cam ring 50.

Figure 7B:
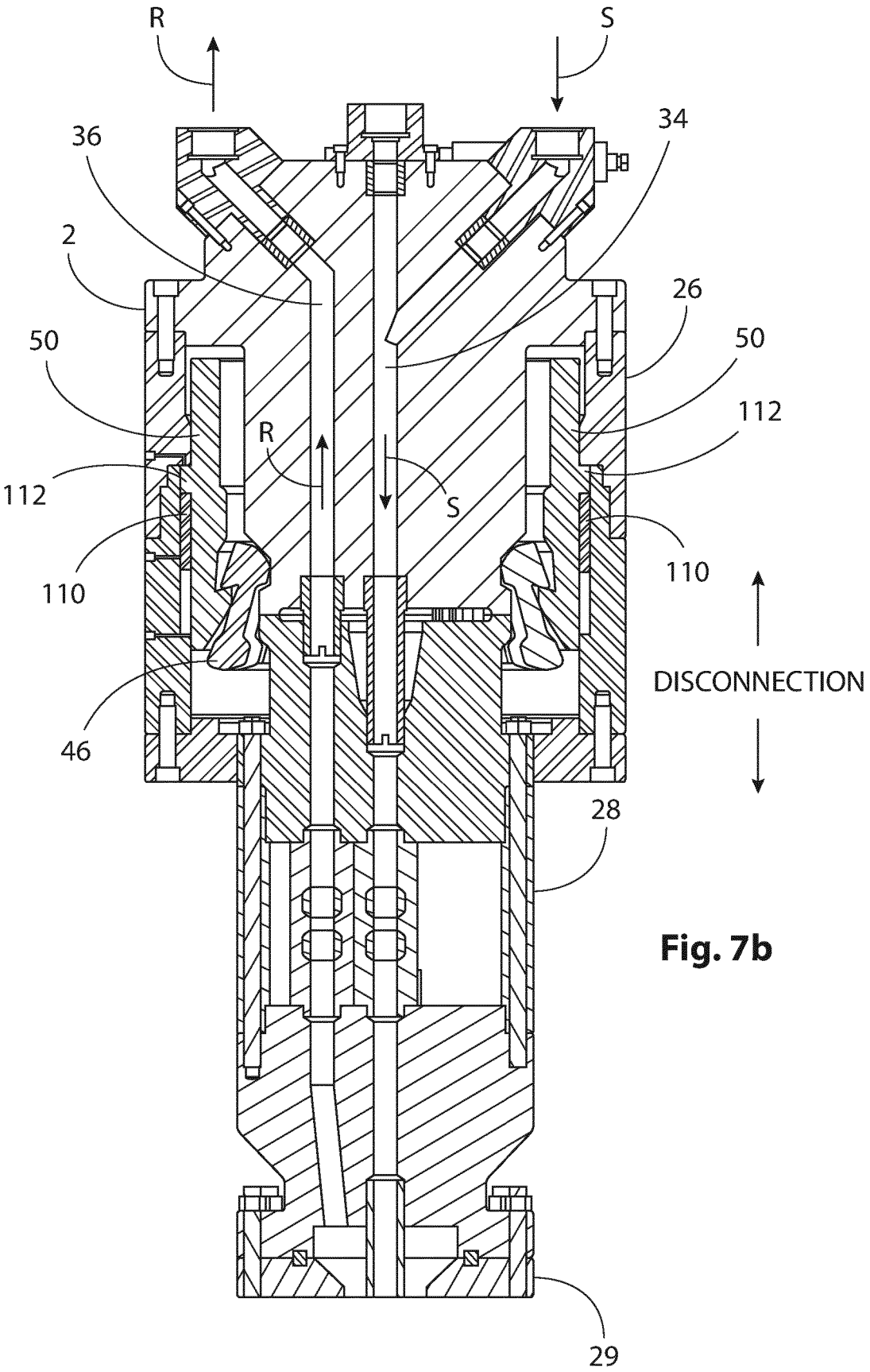

In the event that the movement of cam ring 50 fails due to e.g. failure of a hydraulic circuit, then disconnection ring 110 can be operated (by its own hydraulic system) to move axially in direction D. (Hydraulic fluid is pumped in below the ring 110.) The motion of ring 110 engages circumferential rib 112 driving cam ring 50 upwards and thereby causing dogs 46 to disengage to the unlocked position depicted in FIG. 7*b*. Thus disconnection of disconnection part 26 and the base part 28 can be achieved.

Figure 8A:
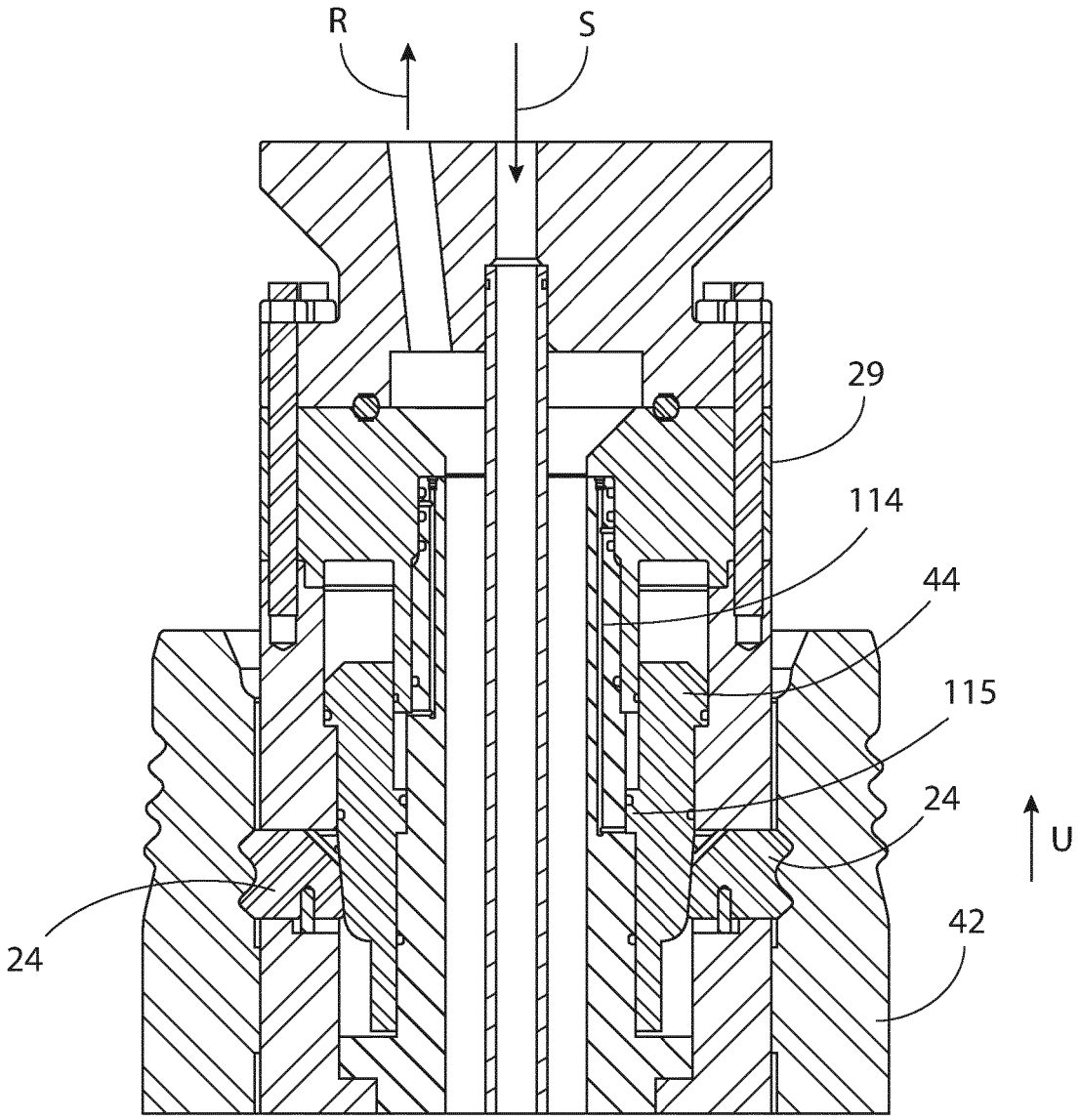
FIGS. 8*a* and 8*b* shows in schematic cross section parts of a wellhead connector section.

FIG. 8*a* shows in schematic cross section a view of the well head connector section 29 of a tool similar to that depicted in FIGS. 2, 2*a* and 2*b* and connected to a subsea well head housing 42. The dogs 24 of the mechanical lock are shown in locking engagement with subsea well head housing 42, held in place by axially moving cam ring 44. The dogs 24 overlap in the radial direction with the subsea wellhead housing 42, preventing movement in the axial direction.

In this example, the axially moving cam ring 44 is movable by hydraulic fluid pressure applied vie passage way 114 to below an inwards projecting rib 115. Fluid pressure applied via passage way 114 causes upwards motion (suggested by arrow U) of the cam ring 44, allowing the dogs 24 to disengage from subsea well head housing 42.

Figure 8B:
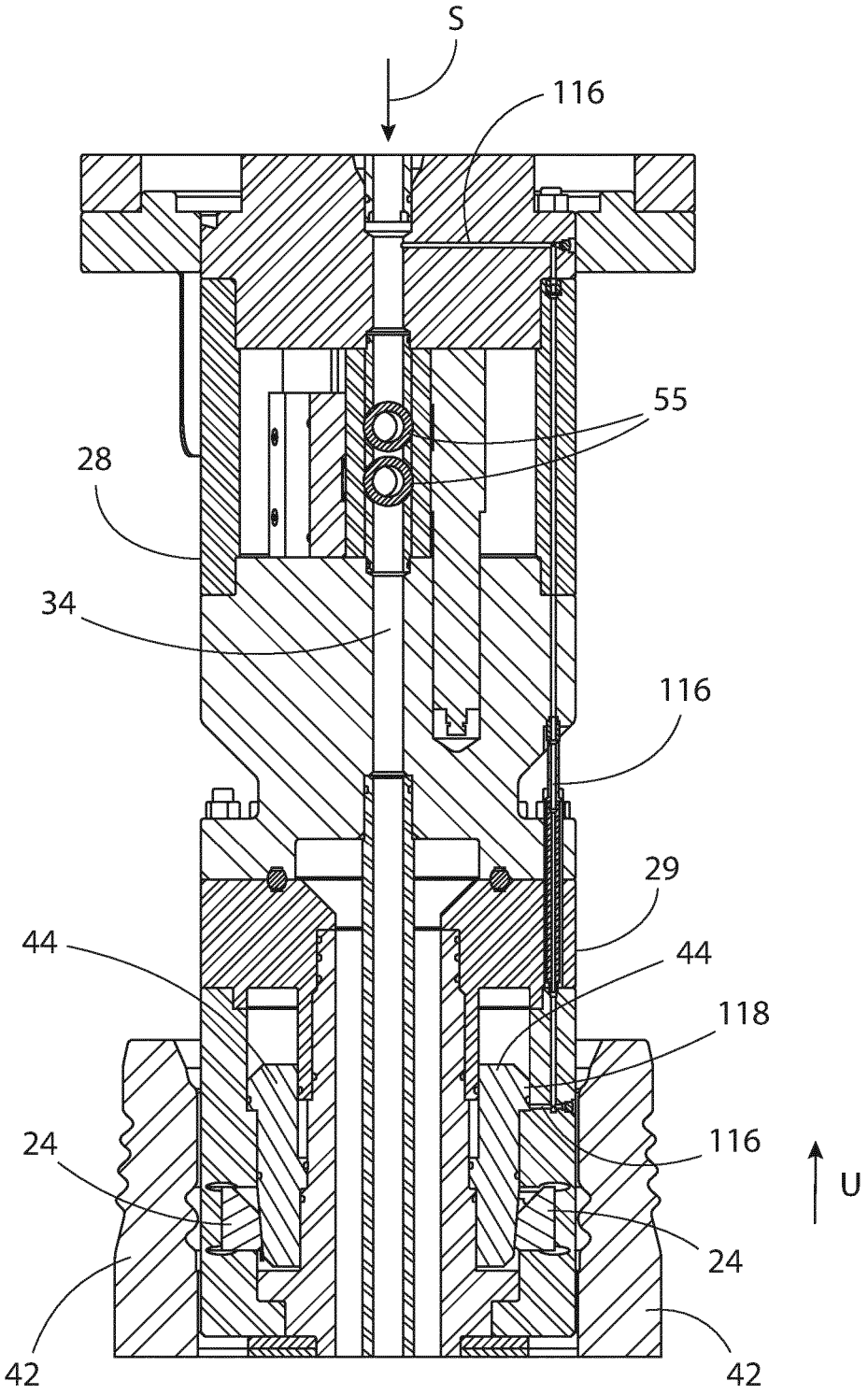

FIG. 8*b* shows the arrangement of FIG. 8*a*, but through a different cross section and with more of the base part 28 of the safety module depicted. This cross-section allows viewing of a separate hydraulic arrangement, that constitutes a secondary unlocking arrangement. Where valves 55 are closed, fluid pressure applied via supply fluid flow path S acts on bursting disc 117 (shown in FIG. 9) in hydraulic fluid passageway 116. Hydraulic fluid can then proceed down passageway 116 to lift axially moving cam ring 44 by pressure applied to beneath an outwards projecting rib 118.

Figure 9:
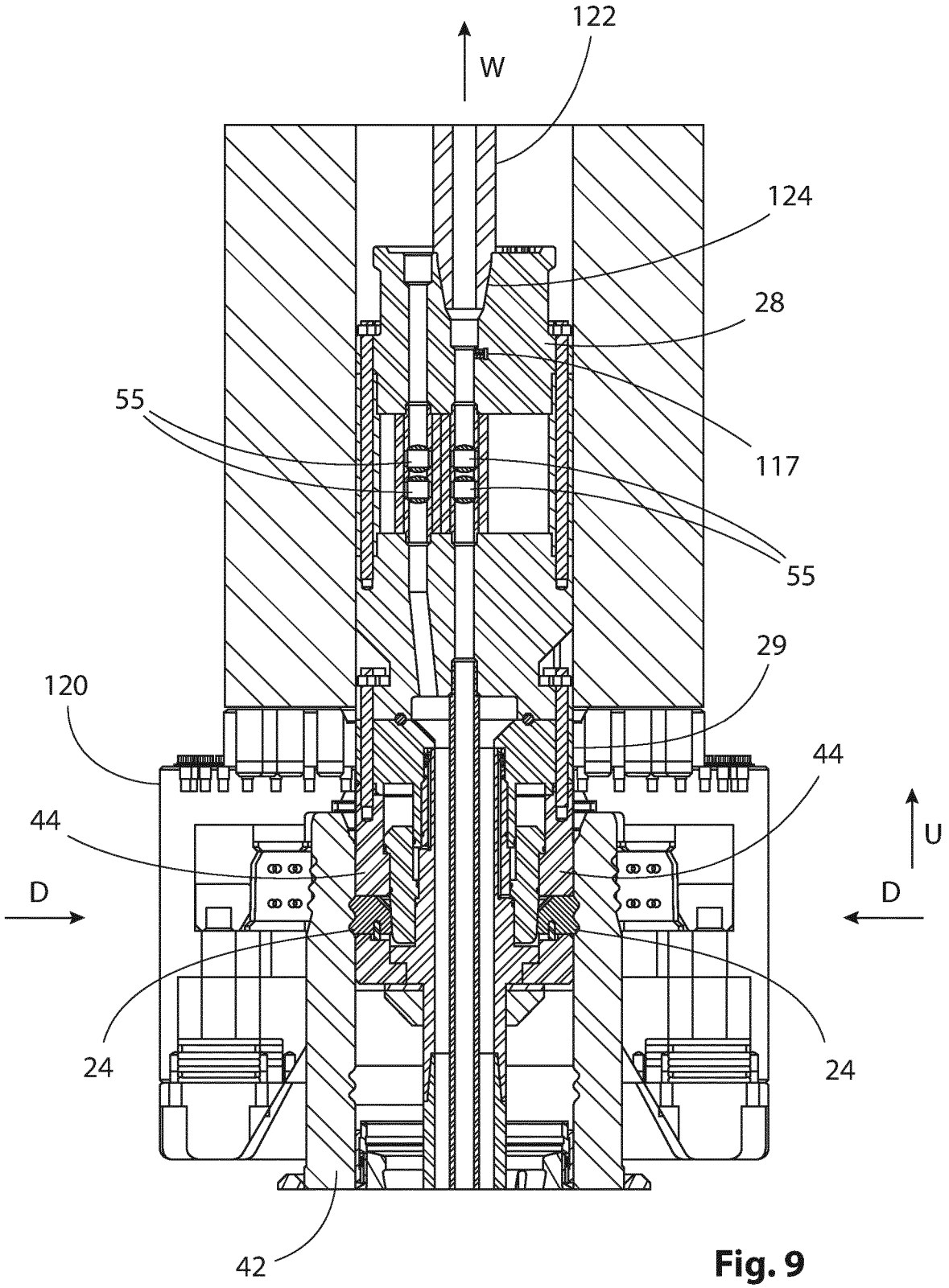
FIG. 9 shows in schematic cross section parts of a wellhead fitted with a Blow Out Preventer, showing retrieval of a tool.

FIG. 9 shows and arrangement where a Blow Out Preventer (BOP) 120 is fitted to a well head housing 42. A base part 28 and lower parts of a tool such as depicted in the preceding figures is still in the well bore.

As depicted in this figure a section of drill pipe 122 is screwed into fitting 124 provided in the base part 28 of the tool, after a disconnection has occurred, such as discussed above with reference to FIG. 7.

The dogs 24 of the mechanical lock are still engaged. To release the mechanical lock the secondary unlocking system as discussed above and with reference to FIGS. 8*b* and 9 is employed. Fluid pressure applied via drill pipe 122 proceeds through bursting disc 117 and enters passageway 116 (FIG. 8*b*) to cause lifting (U) of cam ring 44 allowing disengagement of dogs 24 as suggested by arrows D. At this time the tool can be withdrawn (W) from the well bore and the BOP 118.

As an alternative, the tool may be removed in a similar fashion in situations where a BOP has not been fitted. An ROV can be used to insert a stab into the central bore (instead of drill pipe 122 shown in FIG. 9). Fluid pressure applied via the stab can be used to operate the secondary unlocking system.

Some cementing operations making use of tools and methods described herein will now be described by way of example. Where perforating guns are referred to, it will be understood that other perforating devices may be employed.

1. Single Annulus and Production Bore Cementing
   - 1.1. Perforate production casing with lower perforating gun
   - 1.2. Test and verify integrity of the casing string annulus
   - 1.3. Perforate production casing at upper elevation with upper perforating gun
   - 1.4. Circulate cleaning fluid through the annulus between production and intermediate casing strings to remove debris and to prepare for cement introduction, monitor returning fluid until clean. Cleaning can be by forward circulation, i.e. down supply fluid flow path and returning up the annulus and the return fluid flow path through the tool to surface. The reverse flow can also be used.
   - 1.5. Drop ball to seal off wiper plug
   - 1.6. Pump a volume of cement less than or equal to the volume within the casing string annulus over the distance between the upper and lower perforations. He The wiper plug shears off from its connection at the bottom of the perforation and circulation module and descends into the well like a 'piston' to promote an optimal, undiluted, charge of cement slurry into the annulus. The rate of descent of the wiper plug can be controlled by varying the volume flow-rate of the return fluid and the wiper can only descend to the depth of the lower perforations because the well is sealed below, causing a hydrostatic lock. In one embodiment of the wiper plug this action simultaneously disconnects the lower perforating guns, which are suspended from the wiper plug, however other hydraulically actuated disconnection mechanisms could be used to release the lower perforating guns.
   - 1.7. Following the calculated volume of cement slurry, an additional volume of propulsive fluid would be pumped, referred to as tail fluid, comprising sea water and/or other non-setting fluid. The purpose of the 'tail' is to ensure no residual cement can remain in close proximity to the tool, which could set and seal the tool into the well. (Dilution between the tail and the end of the cement can be minimized by having a slug of a viscous fluid at the front of the tail.
   - 1.8. Open sliding sleeve cross-over valve (XOV) situated between the seals on the tool and circulate cleaning fluid to ensure cement is dispersed from close proximity to the tool.
   - 1.9. Wait for the cement in the annulus to set and pressure test.
   - 1.10. Verify pressure integrity
   - 1.11. Introduce cement into the bore of the production casing. The procedure may include the tool being withdrawn to allow the full desired volume of cement to be introduced whilst avoiding trapping the tool in cement.

1.12. Pressure test the barrier that has been created across the annulus and the production bore.

1.13. The well head may now be removed and the well abandoned.

Two Annuli and Production Bore Cementing

The tool s fitted with first and second lower perforating guns and first and second upper perforating guns. The first set to perforate production casing into an inner annulus and the second set to perforate casings through to the outer, second annulus.

2.1 First/Inner Annulus 2.1.1 Perforate the production casing with 1st lower perforating gun.

2.1.2 Test and verify integrity of the inner annulus.

2.1.3 Perforate the production casing at an upper position, between the seals on the perforating and circulation module with 1st upper perforating device.

2.1.4 Circulate cleaning fluid in the annulus between production and intermediate casing strings to remove debris and to prepare for cement introduction, monitor returning fluid until clean. Cleaning can be by forward circulation, i.e. down supply fluid flow path and returning up the annulus and the return fluid flow path through the tool to surface. The reverse flow can also be used.

2.1.5 Pump a volume of cement less than or equal to the volume within the casing string annulus over the distance between the upper and lower perforations. The preferred method is by reverse circulation during which the charge of cement slurry is held in position in the annulus by balancing with pressure adjustment in the production bore 2.1.6 Open sliding sleeve of XOV and circulate cleaning fluid to ensure any lingering cement is washed out 2.1.7 Wait for cement to set and pressure test 2.1.8 Verify integrity of inner annulus cement plug 2.1.9 Second/Outer Annulus 2.1.10 Perforate production and intermediate casings with 2nd lower perforating gun 2.1.11 Test and verify integrity 2.1.12 Perforate production and intermediary casings at upper elevation with 2nd upper perforating gun 2.1.13 Circulate the second annulus volume between production and intermediate casing strings to remove debris and to prepare for cement introduction, monitor returning fluid until clean. Cleaning can be by forward circulation, i.e. down supply fluid flow path and returning up the annulus and the return fluid flow path through the tool to surface. The reverse flow can also be used.

2.1.14 Drop ball to seal off wiper plug 2.1.15 Pump a volume of cement slurry less than or equal to the volume within the casing string annulus over the distance between the upper and lower perforations and to fill the production bore, from above the lower perforations and to below the tool. The wiper plug shears off from its fixation at bottom of tool and descends into the well like a 'piston' to promote an optimal (undiluted) slug of cement into the annulus. The rate of descent of the wiper can be controlled by varying the volume flow-rate of the return fluid and the wiper can only descend to the depth of the lower perforations because the well is sealed below, causing a hydrostatic lock. In one embodiment of the wiper plug this action simultaneously disconnects the lower perforating guns, which are suspended from the wiper, however other hydraulically actuated disconnection mechanisms could be used to release the lower perforating devices.

The level of cement in the 2nd annulus will tend to balance the length of cement within the production bore, thus establishing cement plugs in both annuli and the bore of approximately equal lengths all at the same elevation 2.1.16 Open sliding sleeve cross-over valve (XOV) and circulate cleaning fluid to wash out as the tool is retrieved. Displaced wellbore liquid mixed with flushing flow would be returned to surface via the annular flow-path within the tool. This avoids the lower parts of the perforating and circulating module becoming stuck by residual lumps of cement slurry.

2.1.17 In one alternative embodiment, the lower seal assembly comprises an expandable packer. In this embodiment the expandable packer incorporates an annular hydraulic piston which acts axially upon a toroidal elastomeric element to open and close an annular an annular space between the toroidal element surface and casing wall, through which liquids could flow. In its relaxed state, when no hydraulic control pressure is applied behind the piston, the element is smaller in diameter than the casing bore, which facilitates liquid flow over the elastomeric element surface. In the energized state, when hydraulic control pressure is applied behind the piston, the resulting axial travel compresses the element which constrains it to expand radially, thereby closing off the annular space. In this way an expandable packer is able to open and close a circulation path between the bottom outlet of the perforation and circulation module and the return flow path between the upper and lower seals. This flow path can be used for cleaning purposes. A flow of cleaning fluid such as seawater can wash out any remaining cement, thus preventing the lower part of the tool from becoming stuck while waiting for the final cement plug to set.

2.1.18 Wait for cement to set and pressure test combined plug in the outer annulus and central bore.

2.1.21 Verify integrity.

2.1.22 Retrieve tooling 2.1.23 The well head may now be removed and the well abandoned.

The invention claimed is:

1. A tool for cementing an annulus in a subsea oil or gas well, the tool comprising:

a safety module and a perforation and circulation module;

wherein the safety module provides fluid communication between an umbilical and the perforation and circulation module, and includes a mechanical lock formed and arranged to make a clamping engagement to an inside surface of a well head in use; and wherein the perforation and circulation module is mounted below the safety module, and comprises:

i) upper and lower seals for sealing to the inner surface of a casing inside a wellbore;

ii) at least one upper perforating device, mounted between the upper and lower seals, for perforating casing;

iii) at least one lower perforating device, mounted below the lower seal, for perforating wellbore casing;

iv) a supply fluid flow path to supply fluid from the safety module through the upper and lower seals to below the perforation and circulation module;

v) a return fluid flow path from between the upper and lower seals to the safety module; and vi) a diversion means in the supply fluid flow path, operable to redirect fluid supplied to the supply fluid flow path to a space defined between the upper and lower seals.

2. The tool of claim 1 wherein the diversion means comprises a valve in the supply fluid flow path, operable to redirect fluid supplied to the supply fluid flow path to the space in-between the upper and lower seals.

3. A tool for cementing an annulus in a subsea oil or gas well, the tool comprising:

a safety module and a perforation and circulation module;

wherein the safety module provides fluid communication between an umbilical and the perforation and circulation module, and includes a mechanical lock formed and arranged to make a clamping engagement to an outside surface of a well head in use; and wherein the perforation and circulation module is mounted below the safety module, and comprises:

i) upper and lower seals for sealing to the inner surface of a casing inside a wellbore;

ii) at least one upper perforating device, mounted between the upper and lower seals, for perforating casing;

iii) at least one lower perforating device, mounted below the lower seal, for perforating wellbore casing;

iv) a supply fluid flow path to supply fluid from the safety module through the upper and lower seals to below the perforation and circulation module;

v) a return fluid flow path from between the upper and lower seals to the safety module; and vi) a diversion means in the supply fluid flow path, operable to redirect fluid supplied to the supply fluid flow path to a space defined between the upper and lower seals.

4. The tool of claim 1 wherein the mechanical lock comprises a plurality of dogs, distributed circumferentially about a surface of the tool and operable, by means of an axially moving cam ring, to move outwards to engage an inner surface of a well head.

5. The tool of claim 1 wherein the mechanical lock comprises a plurality of dogs, distributed circumferentially about a surface of the tool and operable to move inwards by means of an axially moving cam ring to engage an outer surface of a well head.

6. The tool of claim 4 wherein the axially moving cam ring is powered by a hydraulic system.

7. The tool of claim 6 further comprising a secondary unlocking arrangement for unlocking the mechanical lock, the secondary unlocking arrangement comprising a separate hydraulic system, or a separate part of a hydraulic system, from that normally employed to operate the axially moving cam ring.

8. The tool of claim 1 wherein the safety module includes a disconnection system for disconnection and reattachment of an umbilical to the tool without breakage of component parts.

9. The tool of claim 8 wherein the disconnection system of the safety module comprises a disconnection part and a base part; and wherein the disconnection part is for connection to an umbilical and has a quick release coupling for connecting to the base.

10. The tool of claim 9 wherein the quick release coupling is hydraulically operable via the umbilical.

11. The tool of claim 9 wherein the quick release coupling comprises a plurality of dogs, distributed circumferentially about a surface of the disconnection part and operable to move inwards to engage an outwards directed surface of the base.

12. The tool of claim 11 wherein the plurality of dogs of the quick release coupling are operated by an axially moving cam ring.

13. The tool of claim 12 wherein the axially moving cam ring and dogs are formed so that on axial movement of the cam ring to disengage the dogs, the cam ring engages with a hook feature on each of the dogs to positively hold the dogs in the disengaged state.

14. The tool of claim 9 wherein the quick release coupling comprises a plurality of dogs, distributed circumferentially about a surface of the disconnection part and operable to move outwards to engage an inwards directed surface of the base.

15. The tool of claim 14 wherein the plurality of dogs of the quick release coupling are operated by an axially moving cam ring.

16. The tool of claim 15 wherein the axially moving cam ring and dogs are formed so that on axial movement of the axially moving cam ring to disengage the dogs, the axially moving cam ring engages with a hook feature on each of the dogs to positively hold the dogs in the disengaged state.

17. The tool of claim 10 wherein the safety module includes one or more alignment features on at least one of the disconnection part and base part.

18. The tool of claim 12 wherein the safety module includes a secondary disconnection arrangement comprising a disconnection ring operable to move the axially moving cam ring of the quick release coupling.

19. The tool of claim 6 wherein the safety module comprises:

a disconnection system for disconnection and reattachment of an umbilical to the tool without breakage of component parts, said disconnection system including a disconnection part for connection to an umbilical and a base part including the mechanical lock, wherein the disconnection part has a quick release coupling for connecting to the base;

wherein the mechanical lock is formed and arranged to make a clamping engagement to an inside surface of a well head and comprises a plurality of dogs, distributed circumferentially about a surface of the tool and operable, by means of the axially moving cam ring, to move outwards to engage an inner surface of a well head; and wherein the tool further comprises a secondary unlocking arrangement for unlocking the mechanical lock, the secondary unlocking arrangement comprising a separate hydraulic system, or a separate part of a hydraulic system, from the hydraulic system powering the axially moving cam ring.

20. The tool of claim 19 wherein the base part of the safety module includes a connection that allows fluid access to the interior of the tool, to operate the secondary unlocking arrangement when the disconnection part is separated from the base part.

21. The tool of claim 20 wherein the connection that allows fluid access accepts a drill pipe end for transmission of fluid to operate the secondary unlocking arrangement.

22. The tool of claim 19 wherein a bursting disc or other mechanism that opens under the application of excess pressure is used to provide access to the separate hydraulic system or part of a hydraulic system.

23. The tool of claim 19 wherein an axially moving unlocking ring powered by fluid pressure of the separate hydraulic system, or the separate part of a hydraulic system, from that normally employed to operate the axially moving cam ring is employed to unlock the mechanical lock by disengaging the plurality of dogs.

24. The tool of claim 1 wherein the lower seal is a passive seal, operable without control from above.

25. The tool of claim 24 wherein both the upper and lower seals are passive seals.

26. The tool of claim 1 wherein the lower seal is an expandable or inflatable seal.

27. The tool of claim 1 wherein the supply and return fluid flow paths comprise a pipe in pipe arrangement within a mandrel that mounts the upper seal.

28. The tool of claim 2 wherein the valve in the supply fluid flow path is a sliding sleeve valve.

29. The tool of claim 28 wherein the sliding sleeve valve is hydraulically operated.

30. The tool of claim 2 wherein on operation the valve redirects all of the fluid flowing in the supply fluid flow path to between the upper and lower seals.

31. The tool of claim 2 wherein on operation the valve redirects a portion of the fluid flowing in the supply fluid flow path to between the upper and lower seals.

32. The tool of claim 1 wherein the tool is provided with a cement wiper system comprising a wiper plug detachably mounted below the lower seal of the perforation and circulation module.

33. The tool of claim 32 wherein the wiper plug is attached to the tool by a frangible connection.

34. The tool of claim 32 wherein the wiper plug is attached to the tool by a releasable connection.

35. The tool of claim 32 wherein the wiper plug comprises a passage therethrough forming part of the supply fluid flow path.

36. The tool of claim 35 wherein the passage through the wiper plug includes a seat for a ball, whereby a ball dropped into the seat allows pressure from fluid pumped down the supply fluid flow path to cause detachment of the wiper plug from the perforation and circulation module.

37. A method for cementing an annulus in a subsea oil or gas well, the method comprising:

a) providing a tool in accordance with claim 1:

b) deploying the tool, attached to an umbilical, from a surface vessel or rig mounted on the seabed, into the central casing of the well via a well head;

c) operating the mechanical lock to connect the tool into sealing engagement with the well head;

d) operating the at least one lower perforation device, to perforate wellbore casing, thereby allowing fluid communication with an annulus;

e) operating the at least one upper perforating device to perforate wellbore casing between the upper and lower seals, thereby allowing fluid communication with the annulus;

f) cleaning the annulus by at least one of:

passing fluid from, and back to, the surface vessel or rig through the umbilical, the supply fluid flow path, into the annulus and returning via the return fluid flow path and the umbilical, and passing fluid from, and back to, the surface vessel or rig through the umbilical, the return fluid flow path, into the annulus and returning via the supply fluid flow path and the umbilical;

g) charging the annulus with cement by:

passing a charge of cement slurry followed by a tail fluid from the surface vessel or rig through the umbilical, the supply fluid flow path and into the annulus; or by passing a charge of cement slurry followed by a tail fluid from the surface vessel or rig through the umbilical, the return fluid flow path and into the annulus;

h) allowing the cement to set;

i) cleaning between the upper and lower seals by operating the diversion means in the supply fluid flow path to redirect fluid supplied to the supply fluid flow path to a space defined between the upper and lower seals, and at least one of:

passing cleaning fluid from, and back to, the surface vessel or rig through the umbilical, the supply fluid flow path, through the diversion means and returning via the return fluid flow path and the umbilical, and passing cleaning fluid from, and back to, the surface vessel or rig through the umbilical, the return fluid flow path, through the diversion means and returning via the supply fluid flow path and the umbilical; and j) unlocking and removing the tool from the well head.

38. The method of claim 37 wherein the diversion means comprises a valve in the supply fluid flow path, operable to redirect fluid supplied to the supply fluid flow path to the space in-between the upper and lower seals.

39. The method of claim 37 wherein at least one of the upper and lower seals of the tool is an expandable or inflatable seal and the method comprises inflating or expanding the seal or seals into sealing engagement with well bore casing on deployment of the tool.

40. The method of claim 37 wherein the tool comprises a cement wiper system comprising a wiper plug detachably mounted below the lower seal of the perforation and circulation module and step g) is carried out by charging the annulus with cement by:

passing a charge of cement slurry followed by a tail fluid from the surface vessel or rig through the umbilical, the supply fluid flow path and into the annulus with the wiper plug detaching from the perforation and circulation module in advance of the charge of cement slurry.

41. The method of claim 37 further comprising cementing the central casing of the well.

42. The method of claim 41 wherein a further charge of cement slurry is passed into the central casing and followed by a tail fluid.

43. The method of claim 42, wherein the diversion means comprises a valve in the supply fluid flow path, operable to redirect fluid supplied to the supply fluid flow path to the space in between the upper and lower seals, the method further comprising redirecting the bulk of the fluid passing down the umbilical, in advance of the further charge of cement slurry, by operating the valve in the supply fluid flow path;

wherein the redirection is to between the upper and lower seals, thereby allowing fluid to pass down the umbilical and be redirected back up the umbilical via the return fluid flow path.

44. The method of claim 42 further comprising removing the tool from the wellbore as the further charge of cement slurry is delivered.

45. The method of claim 39, when the lower seal is an expandable or inflatable seal, further comprising cleaning between the upper and lower seals by:

deflating or collapsing the lower seal from sealing engagement with well bore casing; and passing cleaning fluid from, and back to, the surface vessel or rig through the umbilical, the supply fluid flow path, and returning via a return fluid flow path including passing upwards in the wellbore casing past the deflated or collapsed lower seal.

46. The method of claim 37 further comprising at least one pressure test selected from the group consisting of:

pressure testing the annulus after the operating the at least one lower perforation device;

pressure testing between the upper and lower seals;

pressure testing after cement has set in the annulus, and pressure testing following cementing the central casing of the well.

47. A method for cementing two annuli in a subsea oil or gas well having a wellbore casing, a first, inner annulus and a second, outer annulus, the method comprising:

a) providing a tool in accordance with claim 1, wherein the tool includes:

at least a second upper perforating device, mounted between the upper and lower seals, for perforating casing or tubing after the first annulus is sealed by cement; and at least a second lower perforating device, mounted below the lower seal, for perforating casing or tubing after the first annulus is sealed by cement;

b) deploying the tool, attached to an umbilical, from a surface vessel or rig mounted on the seabed, into the central casing of the well via a well head;

c) operating the mechanical lock to connect the tool into clamping engagement with an inside surface of the well head;

d) operating the at least one lower perforation device, to perforate the wellbore casing, thereby allowing fluid communication with the first annulus;

e) operating the at least one upper perforating device to perforate the wellbore casing between the upper and lower seals, thereby allowing fluid communication with the first annulus;

f) cleaning the first annulus by at least one of:

passing fluid from, and back to, the surface vessel or rig through the umbilical, the supply fluid flow path, into the annulus and returning via the return fluid flow path and the umbilical, and passing fluid from, and back to, the surface vessel or rig through the umbilical, the return fluid flow path, into the annulus and returning via the supply fluid flow path and the umbilical;

g) charging the first annulus with cement by:

passing a first charge of cement slurry followed by a tail fluid from the surface vessel or rig through the umbilical, the supply fluid flow path and into the first annulus; or by passing a first charge of cement slurry followed by a tail fluid from the surface vessel or rig through the umbilical, the return fluid flow path and into the first annulus;

h) allowing the cement to set;

i) cleaning between the upper and lower seals by operating the diversion means in the supply fluid flow path to redirect fluid supplied to the supply fluid flow path to a space defined between the upper and lower seals, and at least one of:

passing cleaning fluid from, and back to, the surface vessel or rig through the umbilical, the supply fluid flow path, through the diversion means and returning via the return fluid flow path and the umbilical, and passing cleaning fluid from, and back to, the surface vessel or rig through the umbilical, the return fluid flow path, through the diversion means and returning via the supply fluid flow path and the umbilical;

j) operating the at least one second lower perforation device, to perforate the wellbore casing through to the second annulus, thereby allowing fluid communication with the second annulus;

k) operating the at least one second upper perforating device to perforate the wellbore casing between the upper and lower seals, thereby allowing fluid communication with the second annulus;

l) cleaning the second annulus by at least one of:

passing fluid from, and back to, the surface vessel or rig through the umbilical, the supply fluid flow path, into the second annulus and returning via the return fluid flow path and the umbilical, and passing fluid from, and back to, the surface vessel or rig through the umbilical, the return fluid flow path, into the second annulus and returning via the supply fluid flow path and the umbilical;

m) charging the second annulus with cement, thereby charging the wellbore casing by:

passing a second charge of cement slurry followed by a tail fluid from the surface vessel or rig through the umbilical, the supply fluid flow path and into the second annulus; or by passing a second charge of cement slurry followed by a tail fluid from the surface vessel or rig through the umbilical, the return fluid flow path and into the second annulus;

n) allowing the cement to set; and o) unlocking and removing the tool from the well head.

48. The method of claim 47 wherein the diversion means comprises a valve in the supply fluid flow path, operable to redirect fluid supplied to the supply fluid flow path to the space in-between the upper and lower seals.

49. The method of claim 47 wherein the second charge of cement slurry delivered at step m) is calculated to be sufficient to fill both the second annulus to the desired extent and to fill the wellbore casing up to a desired level below the lower seal of the tool.

50. The method of claim 47 wherein the first charge of cement slurry is delivered at step g) by passing the first charge of cement slurry followed by a tail fluid from the surface vessel or rig through the umbilical, the return fluid flow path and into the first annulus.

* * * * *